United States Patent [19]

Kure-Jensen et al.

[11] 4,280,060

[45] Jul. 21, 1981

[54] DEDICATED MICROCOMPUTER-BASED CONTROL SYSTEM FOR STEAM TURBINE-GENERATORS

[75] Inventors: Jens Kure-Jensen; Richard S. Gordon, both of Schenectady; Charles L. Devlin, Ballston Lake; Frederick C. Krings, Schenectady, all of N.Y.

[73] Assignee: General Electric Company, Schenectady, N.Y.

[21] Appl. No.: 157,348

[22] Filed: Jun. 9, 1980

[51] Int. Cl.[3] ..... F01D 17/02

[52] U.S. Cl. ..... 290/40 R; 60/646; 364/494; 415/17

[58] Field of Search ..... 290/40 R, 40 A; 364/494; 60/646; 415/17

[56] References Cited

U.S. PATENT DOCUMENTS

| | | | |
|---|---|---|---|
| 3,097,488 | 11/1961 | Eggenberger et al. | 415/17 |
| 3,446,224 | 5/1969 | Zwicky, Jr. | 415/17 |
| 3,552,872 | 4/1969 | Giras et al. | 415/17 |
| 3,561,216 | 2/1971 | Moore, Jr. | 60/73 |
| 3,741,246 | 6/1973 | Braytenbah | 415/17 |
| 3,891,344 | 6/1975 | Braytenbah | 415/1 |
| 3,934,128 | 1/1976 | Uram | 290/40 R |
| 3,937,934 | 2/1976 | Pasemann | 290/40 R |
| 4,029,951 | 6/1977 | Berry et al. | 290/40 R |
| 4,046,002 | 9/1977 | Murphy et al. | 73/116 |
| 4,053,746 | 10/1977 | Braytenbah et al. | 364/494 |
| 4,071,897 | 1/1978 | Groves, Jr. et al. | 364/494 |
| 4,099,237 | 7/1978 | Zitelli et al. | 364/494 |
| 4,104,908 | 8/1978 | Timo et al. | 73/117.3 |
| 4,133,615 | 1/1979 | Zitelli et al. | 415/43 |
| 4,177,387 | 12/1979 | Malone | 290/40 R |
| 4,181,840 | 1/1980 | Osborne | 290/40 R |
| 4,204,258 | 5/1980 | Zitelli et al. | 364/494 |
| 4,212,057 | 7/1980 | Devlin et al. | 364/200 |

*Primary Examiner*—J. V. Truhe
*Assistant Examiner*—Donald L. Rebsch
*Attorney, Agent, or Firm*—Ormand R. Austin; John F. Ahern

[57] ABSTRACT

A dedicated supervisory control system for a steam turbine-generator comprising a hierarchy of microcomputer subsystems interactive with a conventional analog electrohydraulic control system to provide control and monitoring capabilities during all operating phases of the turbine-generator. The separate microcomputer subsystems are programmed for coordinated interaction and communication through shared, dual-port read/-write memory units and each microcomputer subsystem is programmed and configured to handle a separate group of control responsibilities in a distributed control system. The microcomputer hierarchy includes an input and calculations computer having means for interfacing with analog input data sources and sensors which report on various operating parameters of the turbine-generator and from which thermal and mechanical stress and other derived quantities are calculated; a display and communications computer adapted to interface with a plant computer and with an operator control panel and other display and readout devices whereby operating personnel may interact with the control system; and a control computer, standing at the top of the hierarchy, for receiving information from the other computers, for making decisions based on that information and, through input/output ports, for providing the electrohydraulic control system with directions for optimal control of the turbine-generator within its thermal and mechanical limitations. The dedicated supervisory controller provides a plurality of operating modes.

22 Claims, 17 Drawing Figures

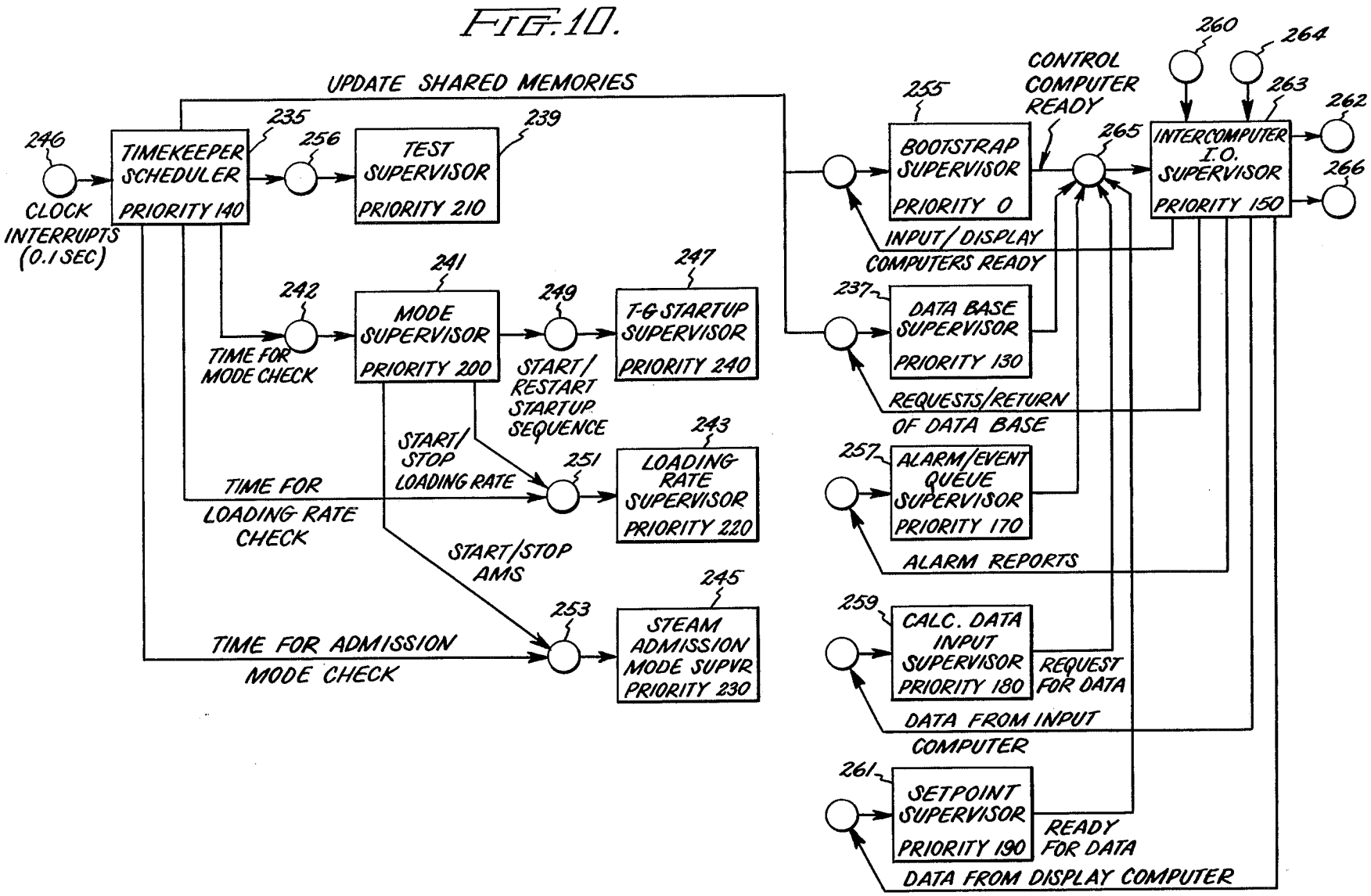
FIG. 10.
UPDATE SHARED MEMORIES
CLOCK INTERRUPTS (0.1 SEC)
246
TIMEKEEPER SCHEDULER PRIORITY 140
235
256
TEST SUPERVISOR PRIORITY 210
239
242
TIME FOR MODE CHECK
MODE SUPERVISOR PRIORITY 200
241
249
START/RESTART STARTUP SEQUENCE
T-G STARTUP SUPERVISOR PRIORITY 240
247
START/STOP LOADING RATE
251
LOADING RATE SUPERVISOR PRIORITY 220
243
TIME FOR LOADING RATE CHECK
START/STOP AMS
253
STEAM ADMISSION MODE SUPVR PRIORITY 230
245
TIME FOR ADMISSION MODE CHECK
BOOTSTRAP SUPERVISOR PRIORITY 0
255
INPUT/DISPLAY COMPUTERS READY
CONTROL COMPUTER READY
265
DATA BASE SUPERVISOR PRIORITY 130
237
REQUESTS/RETURN OF DATA BASE
ALARM/EVENT QUEUE SUPERVISOR PRIORITY 170
257
ALARM REPORTS
CALC. DATA INPUT SUPERVISOR PRIORITY 180
259
REQUEST FOR DATA
DATA FROM INPUT COMPUTER
SETPOINT SUPERVISOR PRIORITY 190
261
READY FOR DATA
DATA FROM DISPLAY COMPUTER
INTERCOMPUTER I.O. SUPERVISOR PRIORITY 150
260
264
263
262
266

DEDICATED MICROCOMPUTER-BASED CONTROL SYSTEM FOR STEAM TURBINE-GENERATORS

This invention relates generally to control systems for steam turbine-generators, and more particularly to a supervisory control system wherein a hierarchy of microcomputers provides optimum direction, during all phases of turbine-generator operation, to an analog electrohydraulic control system having direct control of turbine-generator operation.

BACKGROUND OF THE INVENTION

Semi-automatic control systems capable of on-line control of a steam turbine and able to start, load, and unload the turbine in response to a few discrete commands supplied by an operator (e.g., target speed, acceleration, target load, and loading rate) have been known and used for several years. These control systems, implemented largely with analog electronic and electrohydraulic components, have provided very precise control while building a good record of durability and reliability. Nevertheless, there has been a continuing need for a fairly high degree of human interaction with the controller, particularly during periods of non-steady state operation. To provide direction prudently, operators have had to take guidance from turbine stress monitoring instruments and various other instrument systems and monitoring devices. Recently, the scarcity and high cost of energy has fostered the development of larger, more refined, and more efficient turbine-generators for which the electrical utilities have sought means to ensure the ability to start, stop, change loads, etc., in response to changing load demands in the most flexible and economical manner. This has led to the development of highly refined supervisory instrumentation and monitoring systems, but it has also made the duty of the operator more demanding by requiring that he absorb and process an increasing amount of information as he further directs control of the turbine-generator.

To aid operators in these supervisory tasks, large digital computers have been programmed and utilized to supervise and start, load, and unload the turbines by exercising supervision of the above mentioned on-line, semi-automatic control systems. These applications have been fairly successful, although to justify the use of large main-frame computers, turbine supervision and control has been only one of many tasks assigned to the computer. Other tasks commonly assigned include control and supervision of the boiler and power plant auxiliary equipment, performance calculations, sequence monitoring, and data logging. Due to the complexity and diversity of these and other assigned tasks, reliability of control with large computers has not always been as high as is desirable for electrical utility use. Also, because of the cost, not all turbine-generator users have been able to justify a computerized, fully automatic control system.

Accordingly, it is an object of the present invention to provide a dedicated, computerized control system capable of optimally and automatically starting, loading, and unloading a turbine-generator within its thermal and mechanical constraints and to provide this capability without discarding, but rather by building upon, the well-tested, highly reliable analog electrohydraulic control systems.

Another object of the present invention is to provide a lower cost alternative to the large main frame computer for steam turbine-generator control by providing a microcomputer-based, distributed control system dedicated to supervisory control and which is economically justified without the necessity of serving other, auxiliary functions.

A further object of the invention is to provide improved supervisory and protective capabilities in an integrated, dedicated computer control system for a large steam turbine-generator wherein the control system has various operating modes including a monitor mode, a supervisory control mode, and a subloop control mode whereby a large, plant computer, requiring minimal programming, can direct turbine-generator operation and receive reports regarding its progress.

To those skilled in the art, still further objects and improvements offered by the invention will be apparent from the following description of the principles and operation of the invention and of its preferred embodiment.

SUMMARY OF THE INVENTION

The invention provides a dedicated supervisory control system comprising a hierarchy of microcomputer subsystems which, in combination, advantageously directs and interacts with a conventional analog electrohydraulic control (hereinafter sometimes referred to as an EHC system) having direct feedback control of a steam turbine-generator of the type used for large-scale generation of electrical power. The separate microcomputer subsystems are programmed for coordinated interaction and communication through shared, dual-port read/write memory units and each microcomputer subsystem is programmed and configured to handle a separate group of control responsibilities. There is, in effect, a distribution of control response between computers of the hierarchy. Thus, the microcomputer hierarchy includes an input and calculations computer having means for interfacing with analog input data sources and sensors which report on various operating parameters of the turbine-generator and from which thermal and mechanical stress and other desired quantities are calculated; a display and communications computer adapted to interface with a plant computer and with an operator control panel and other display and readout devices such as printers and cathode ray tubes (CRT's) whereby operating personnel may interact with the control system; and a control computer, standing at the top of the hierarchy, for receiving information from the other computers, for making decisions based on that information and, through input/output ports, for providing the electro-hydraulic control system with directions for optimal control of the turbine-generator within its thermal and mechanical limitations.

Each microcomputer subsystem includes a central processor unit (CPU); one or more signal busses; read only memory units (ROM's) for stored program memory; random access memory units (RAM's) for scratchpad, interim storage of information; a high-speed arithmetic processor unit; a watchdog timer network; networks to handle internal communications and interrupt requests; and special interfacing networks adapted to couple the microcomputer subsystem to external operating elements associated with that particular microcomputer (e.g., to interface with the electrohydraulic control system or to take in measured analog data). Additionally, there is a system and real-time clock according to which the system operates.

The supervisory controller of the present invention provides a plurality of operating modes. These include a monitor mode wherein operating personnel are guided through all phases of turbine-generator operation by announcements and directions which appear on a CRT or other readout devices and in which the operator causes advancement from one turbine operating phase to another; a control mode wherein the operating decisions are automatically made and the turbine is advanced through all operating phases with a minimum of operator interaction; a remote automatic mode wherein turbine control is turned over to a centralized automated dispatch system (ADS) or a coordinated boiler-turbine control system (CBC) once the turbine has reached a basic target load and wherein the ADS or CBC operates by interacting with the controller; and a plant computer control mode wherein the control system functions as a subsystem in an overall plant control scheme so that very minimal, straight-forward programming of the plant computer is required to achieve turbine-generator control.

The supervisory controller directs the EHC system (or, in the monitor mode, preps the operator so that he can most judiciously direct the EHC system) by causing the turbine to proceed through a logical operating sequence while omitting steps not needed under the prevailing conditions. For example, to effect a startup of the turbine, steps are included for rotor prewarming and for chestwarming, followed by a step to prepare for rolloff, which step includes a validation check of calculations made and a determination that the available steam is of satisfactory condition as to pressure, temperature, etc. Progress of these and other steps is monitored by posting appropriate information to the operator through the CRT display. Once preparation for rolloff is complete the turbine is rolled free of the turbine gear (a motor-gear drive arrangement to turn the rotor during pre-warming) and a first target rotor speed and an acceleration rate to reach the speed are selected. When the first preselected speed has been reached, the controller determines whether the turbine speed may be further increased or whether to hold speed until sufficient warming and reduction in turbine stresses have taken place. In any case, the controller directs the operation by selecting optimal speed levels and acceleration rates, while maintaining acceptable levels of stress to turbine components, until a speed is reached at which the turbine-generator can be synchronized to supply electrical power at the required line frequency.

Other turbine-generator functions controlled or monitored by the microcomputer-based supervisory control system include application of the generator field; initiation of synchronization of the generated power frequency to the line or power grid frequency; loading and unloading to and from a target power load; turbine admission mode selection whereby partial arc or full arc admission of steam is selected as a function of turbine operating conditions to provide the most efficient operation; and turbine stress analysis and control.

The controller, comprising a hierarchy of microcomputers, operates and performs its functions, as summarized above, according to programs and subprograms stored in the permanent memory units (ROM's). The computers perform their functions concurrently and, with interrupts and handling of tasks on a priority basis, subprograms are performed concurrently even within the same processor unit. The microcomputers are programmed to take in information pertaining to turbine-generator operation, to process that information, to decide how the turbine should be made to respond, and to either automatically direct the electrohydraulic control system or to provide appropriate information to an operator so that he can manually direct the EHC system.

BRIEF DESCRIPTION OF THE DRAWINGS

FIG. 10 is a program structure and message flow diagram for the control computer of FIGS. 1 and 4;

DETAILED DESCRIPTION OF THE INVENTION

1. System Structure

Figure 1:
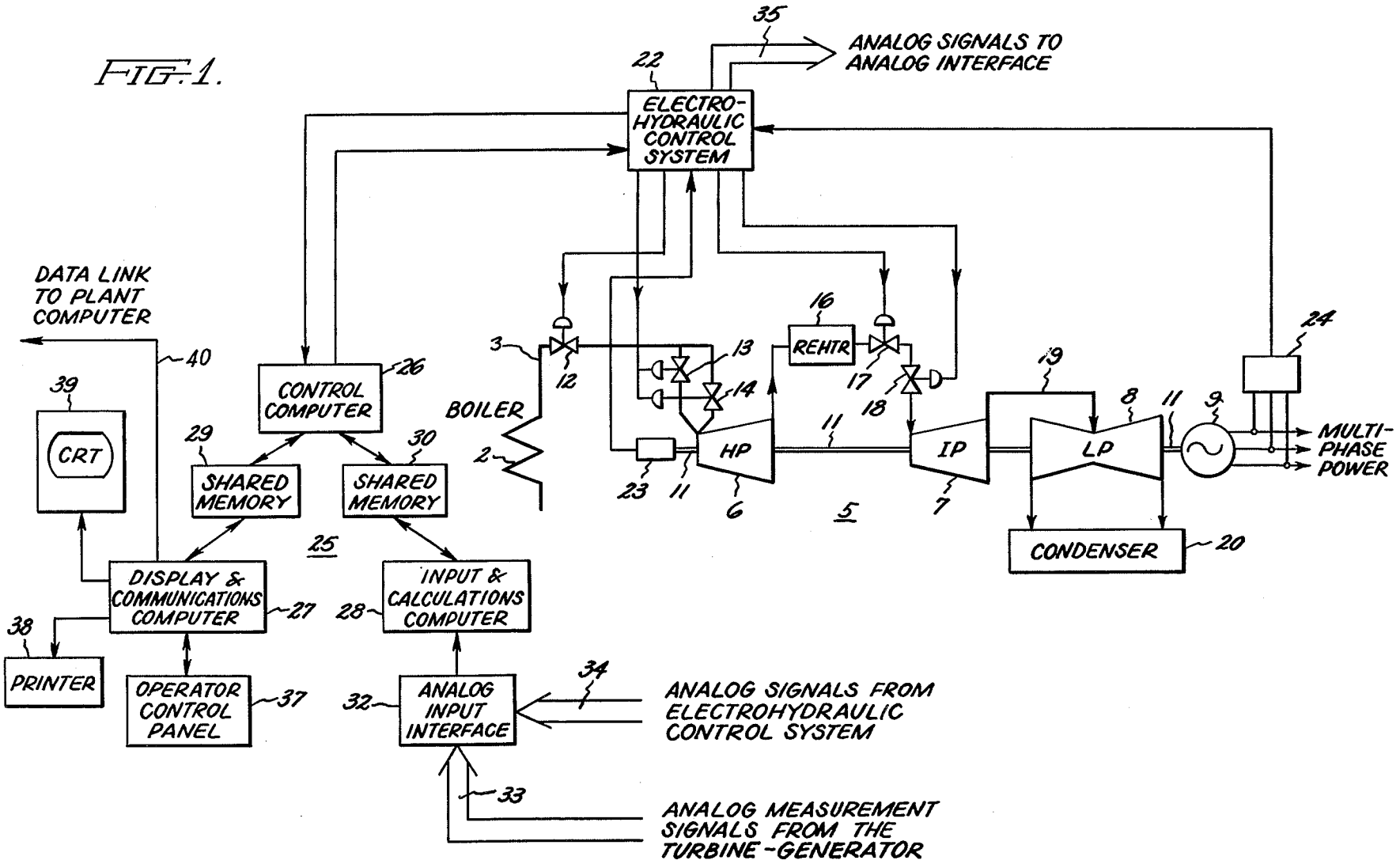
FIG. 1 is a schematic diagram illustrating a hierarchical arrangement of microcomputers to form a supervisory control system according to the present invention and showing the relationship of such control system to a typical power plant having an electro-hydraulic control system for turbine-generator control.

The electrical power generating plant shown schematically in FIG. 1 includes a turbine-generator set which is advantageously controlled by a dedicated microcomputer-based control system according to the present invention. In the power plant as shown, boiler 2 supplies high-pressure, high-temperature steam through conduit 3 to drive turbine 5 comprising a high-pressure section 6, an intermediate section 7, and a low-pressure section 8. Turbine sections 6, 7, and 8 may be tandemly coupled to each other and to electrical generator 9 by shaft 11 as shown. Steam to turbine 5 is initially admitted through main stop valve 12 and subsequently through a set of control valves 13 and 14. Although two control valves are illustrated for the purpose of explaining the invention, a plurality of stop and control valves are commonly used with the control valves arranged circumferentially in a well-known manner in nozzle arcs about the inlet to high-pressure section 6. Such an arrangement of control valves effectively provides admission of steam to turbine section 6 in either the partial arc mode of operation wherein steam is admitted through less than all of the control valves such as valves 13 and 14, or in the full arc mode wherein steam is admitted simultaneously through all of the control valves.

Steam exhausted from high-pressure section 6 passes through reheater 16 wherein the enthalpy of the steam is increased, through reheat stop valve 17, and through intercept valve 18 to enter intermediate pressure section 7 and provide motive fluid therefor. Steam from the intermediate section 7 enters low-pressure section 8 via steam conduit 19 and from the low-pressure section 8 is finally exhausted to condenser 20 from whence there is a recycle path (not shown) to the boiler 2.

Speed of the turbine and the amount of load it drives are dependent upon the quantity and condition (temperature and pressure) of the steam admitted to the turbine sections 6, 7, and 8 through control valves 13 and 14, stop valves 12 and 17, and through the intercept valve 18. Speed and load control, and of the turbine generally, are provided by an electro-hydraulic control (EHC) system 22. The EHC system 22 is preferably of the type disclosed in U.S. Pat. No. 3,097,488 to Eggenberger et al, which disclosure is incorporated herein by reference thereto, and is an analog, feedback type controller adapted to receive input information regarding turbine operation as from speed transducer 23 and electrical load transducer 24 and, by appropriately positioning control valves 13 and 14 in conjunction with stop valves 12 and 17 and intercept valve 18, to maintain turbine operation at desired, preselected setpoint values.

The EHC system 22 is capable of stand-alone control of the turbine 5 according to operator guidance in consideration of operating conditions and safety limits, and provides means for steam admission mode selection, and protective measures against such abnormal conditions as turbine overspeed, excessive temperature and vibration. Preferably, the EHC system 22 includes apparatus adapted to the method of steam admission transfers disclosed and claimed in U.S. Pat. No. 4,177,387 to Malone, the disclosure of which is incorporated herein by reference thereto.

A dedicated supervisory controller 25 is provided to interact with the EHC system 22 and give direction thereto for optimal turbine-generator performance under all operating conditions and during all operating phases. Supervisory control information thus given to the EHC system 22 is determined by continuous measurements of turbine-generator operating parameters and a data base of information related to other nonsensed turbine-generator parameters. The supervisory controller 25 comprises a hierarchy of microcomputer subsystems including control computer 26 having interfacing capabilities with the EHC system 22; a display and communications computer 27; and an input and calculations computer 28. The distribution of function between microcomputers may be referred to herein as providing distributed control. Control computer 26 is the basic, decision-making computer in the hierarchy, communicating, respectively, with the display and communications computer 27 and with the input and calculations computer 28 through shared memory units 29 and 30 which are dual-port random access memory units. Analog input interface 32 is a subsystem to provide signal conditioning, isolation, and analog-to-digital conversion for analog signals indicative of turbine-generator operating parameters. The analog signals may be obtained by direct measurements on the turbine as indicated by input lines 33 (to be taken as indicating a plurality of inputs) or they may be obtained secondarily through EHC system 22 as indicated by analog input lines 34 and EHC output lines 35.

The input and calculations computer 28 reads the input signals after they have been converted to digital format, validates the input signals by comparing them to maximum and minimum acceptable values and to companion input values, and converts the input signals to engineering units. The data thus taken in is retained until updated by subsequent acquisition of data, and is supplied, as requested, to operating programs and subprograms either within input and calculations computer 28 or within the control computer 26.

The input and calculations computer 28 also provides means for calculating thermal and mechanical stresses to turbine components such as the turbine rotor and shell (based on input measurement signals), and for supplying this derived information to control computer 26. Based on the determined stress levels, the control computer 26 provides direction to the EHC system 22, which has direct control of the turbine, so that stress is minimized. Stress is determined according to the teaching of Zwicky, Jr. in U.S. Pat. No. 3,446,224, and according to subsequent improvements in the art including the teachings and methods of U.S. Pat. No. 4,046,002 to Murphy et al and U.S. Pat. No. 4,104,908 to Timo et al, the disclosures of which are incorporated herein by reference thereto.

Since the useful life of a turbine component part is affected by the unavoidable cyclic stresses which occur as a result of the cyclic heating, cooling, and centrifugal loading which occur during startup, load changes, shutdowns, and sudden changes in steam conditions, the input and calculations computer 28 determines the amount of life expended during these stress cycles for predetermined turbine parts. The values determined may be expressed as a percentage of life expended for the stress cycle and is referred to as cyclic life expenditure or CLE. The life expended for each stress cycle is accumulated to provide an output indicative of CLE for the particular turbine part (e.g., the rotor) according to the part's physical properties and geometry, which information is stored within the permanent memory of the input and calculations computer 28. CLE is displayed to operating personnel by display devices (not shown in FIG. 1) interfaced to the input and calculations computer 28.

Furthermore, the input and calculations computer takes into account the turbine rotor material of construction and the behavioral characteristics of that material above and below the fracture appearance transition temperature (FATT) which is the boundary temperature between brittle and ductile behavior of the rotor material. At lower temperatures the material is relatively more brittle whereas at higher temperatures the ductility is increased. Certain stress levels occurring below the transition temperature may be undesirable while those same stress levels above the transition temperature may be acceptable. Hence, the transition temperature divides a stress versus temperature plot into brittle and ductile regions which are further divided into zones of potential risk of permanent damage to the rotor. The input and calculations computer 28 provides for a comparison between the instantaneous or actual rotor stress and an allowable rotor stress, and accumulates the data in separate counter registers respectively scoring incidents in the brittle and ductile regions.

Both of the foregoing stress determining and calculating methods are programmed into the input and calculations computer 28 and are made according to the teachings of the U.S. Patents incorporated by reference above.

Display and communications computer 27 is an input-/output subsystem interfaced to an operator control panel 37 which allows the operator to interact with the control system 25; to a printer unit 38 which provides a permanent record of data and messages printed out from the control system 25; and to a CRT display unit 39 which presents messages/requests to the operator. Additionally, a data link 40 is provided through the display and communications computer 27 to a plant computer whereby, in one operating mode of the controller 25, the plant computer provides input commands to, and receives progress reports from, the control system 25. In this mode the plant computer uses the control system 25 as a subsystem in overall plant control. However, it is to be noted that the plant computer is not programmed to duplicate the functions of the control system 25.

Figure 2:
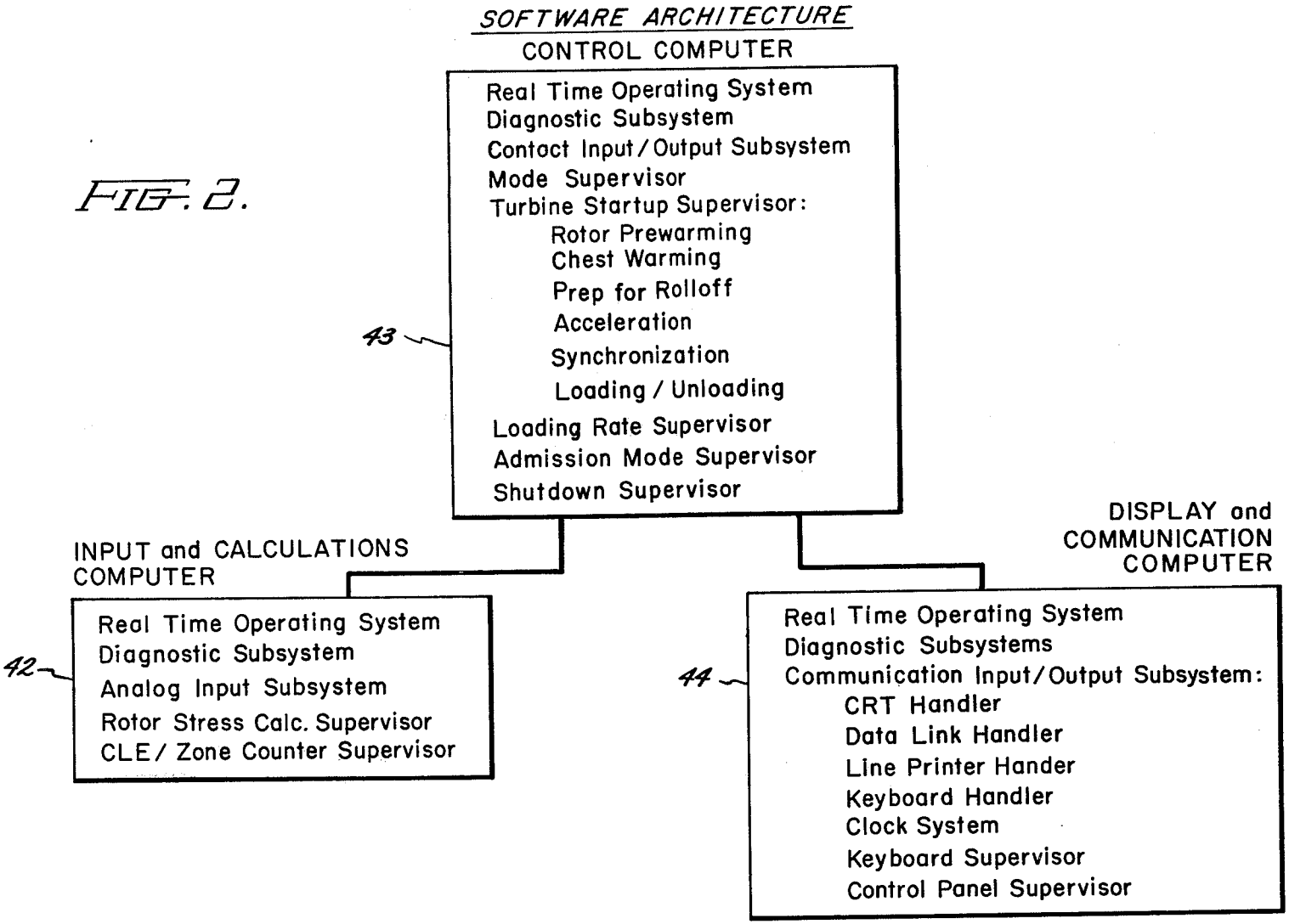
FIG. 2 is a block diagram illustrating a software architecture for the hierarchical arrangement of microcomputers of FIG. 1.

FIG. 2 illustrates software architecture for the microprocessor hierarchy of controller 25 and includes listings of major subprograms resident in each microcomputer subsystem. FIG. 2 further depicts the distributed control concept and will assist in an understanding of the invention when considered with the following, more specific description.

Figure 3:
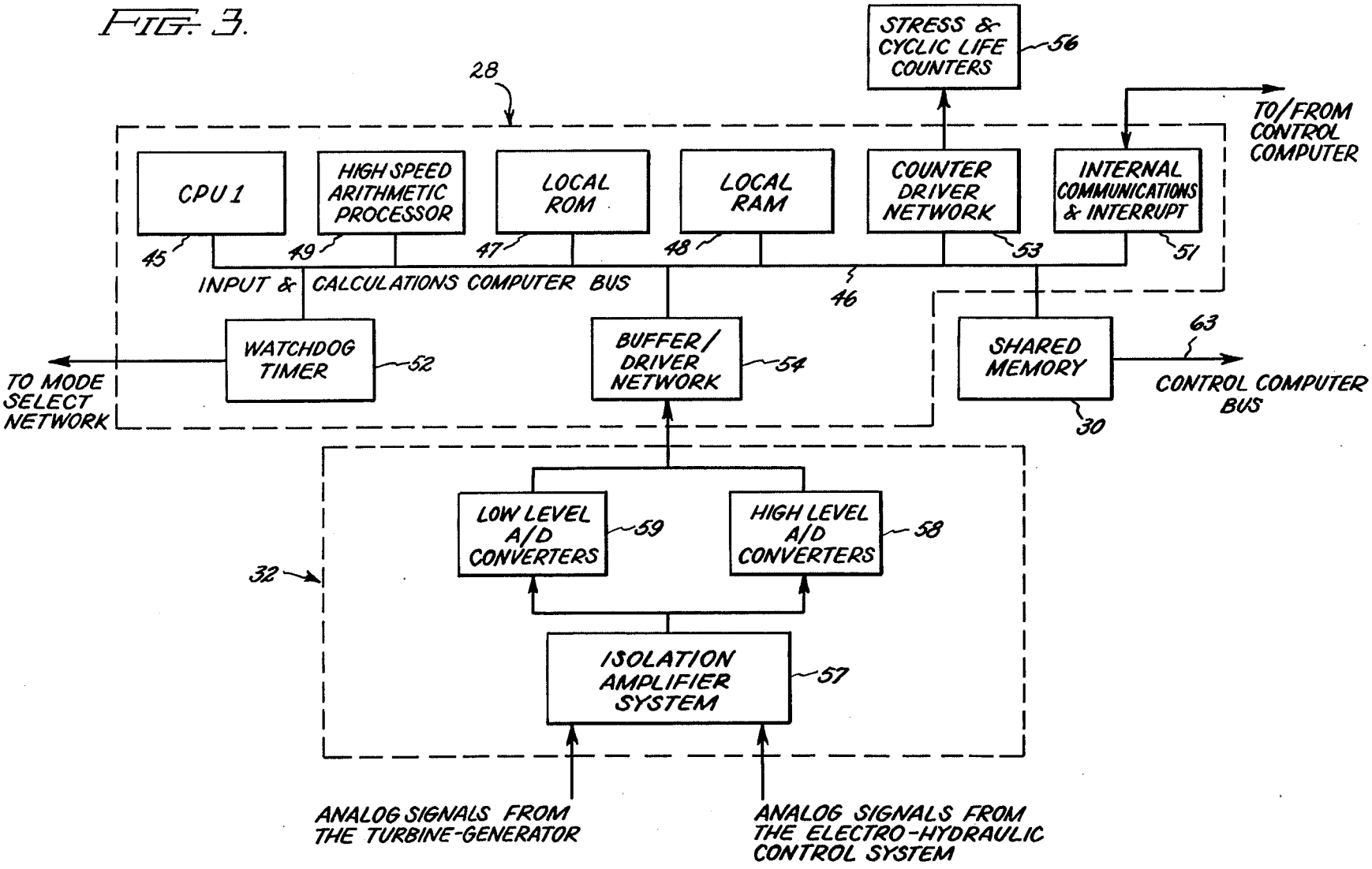
FIG. 3 is a block diagram of the input and calculations computer and of the analog input interfacng circuitry, both of FIG. 1.

The input and calculations computer 28 of FIG. 1, comprising a stored program digital microcomputer, is further illustrated by the block diagram of FIG. 3 in which central processing unit (CPU) 45 provides the synchronizing and program execution means for the microcomputer 28. CPU 45 (as well as all other CPU's herein described for use with this preferred embodiment) may be of the type manufactured and sold by the Intel Corp. as the 8085A CPU, and, in any case, is preferably a large-scale integrated circuit (LSI) device. Operational capabilities and architectural arrangement of the functional elements of the 8085A and of other suitable CPU units may be obtained from the manufacturer's literature. Communications between elements comprising the input and calculations computer 28 is by way of a signal bus system 46 to which the elements are connected in essentially a parallel arrangement. Bus 46 provides the pathway for digital signal flow and may include separate busses for memory addressing, for bidirectional data flow, and for intracomputer control signal flow. The bus structure, its utility, and the flow and control of signals thereon will be well known to those of ordinary skill in the art. Read only memory unit (ROM) 47 is a permanent storage device, or group of devics, containing the instruction steps comprising the program to be selected and executed by CPU 45 while random access memory (RAM) 48 is a temporary storage memory device, or group of storage devices, allowing both read and write operations to be executed by CPU 45 and providing for interim storage of data. Both ROM 47 and RAM 48 are preferably semiconductor type memories compatible with the operation of CPU 45. Those functions and tasks programmed into the input and calculations computer 28 are given within block 42 of FIG. 2 which shows the overall software architecture for the control system 25. High-speed arithmetic processor 49 performs the actual work of computation and calculations, and although such computation may be realized through programming of CPU 45 without inclusion of a specific hardware item such as arithmetic processor 49, calculation capability and speed are enhanced by its use. Arithmetic processor 49, as well as all other high-speed arithmetic processors used or described herein, may, for example, be of the type manufactured and sold by Advanced Micro Devices, Inc. as the AM9511 Processor.

Coordination of control and handling of interrupt signals between the input and calculations computer 28 and the control computer 26 is through internal communications and interrupt network 51. This network 51 handles interrupt signals between the two computers so that either may be interrupted by the other; either computer thus is able to request that the other give attention to some designated task on a priority basis. Other control signals are also exchanged between computers via internal communications and interrupt network 51 so that in effect each computer always knows what the other is doing. The internal communications network 51 comprises an output port of the input and calculations computer 28 and a priority interrupt controller such as is well known in the art. For example, internal communications network 51 may include a priority interrupt controller such as that made and sold by the Intel Corp. as Model 8259. Other internal communications and interrupt networks used or described herein may also be configured using the Intel 8259.

Input and calculations computer 28 also includes watchdog timer 52, counter driver network 53, and buffer/driver network 54. Watchdog timer 52 monitors performance of the computer 28, and, in the event of failure, provides a signal indicative thereof so the control system can automatically be put into a safe operating mode (the monitor mode, more fully discussed hereinafter). The computer 28 is periodically put through a test according to its programming, and unless satisfactory results therefrom are received by the watchdog timer 52 before a preselected timeout period expires, the failure mode is selected. The counter driver network 53 is an interfacing network which accepts digital data relative to CLE events and to high-stress events categorized with respect to the fracture appearance transition temperature, and transfer that data to stress and cyclic life counters 56 so that these high-stress events and fractional life expenditures are accumulated and displayed. The stress data is determined in accord with the program of the input and calculations computer 28 operating upon sensor information brought in from the turbine-generator through analog interface 32. Counter driver network 53 preferably comprises a buffer and shift register, but may also be designed using other components, as will be recognized by those skilled in the art.

The analog input interface 32, also included in FIG. 3, provides isolation, signal conditioning, and accepts the analog input signals pertaining to turbine-generator operation. The analog signals are the fundamental pieces of information upon which the control system operates to determine further, derived information or control parameters according to which the turbine-generator can best be operated. The analog input signals may be obtained directly, in which case the sensing devices, such as thermocouples or RTD's for example are connected directly to the input interface 32. Alternatively, the analog signals may be obtained indirectly, and the analog signals brought to the input interface 32 via the EHC system 22. Analog input signals include the following:

| Signal | Source |
|---|---|
| Temperature | Control valves-outer and inner surfaces |
| Temperature | Steam crossover chamber |
| Temperature | Reheat bowl |
| Temperature | High-pressure shell |
| Temperature | Lube oil |
| Temperature | Main steam |
| Temperature | Reheater |
| Pressure | Steam chest |
| Pressure | Main steam |
| Speed | Shaft-mounted transducer |
| Power | Watts transducer-power line |
| Valve position | Control valves |
| Load level | Load set motor |
| Admission mode | Admission mode select motor |

Although the signal sources, as listed in the above table, are not, in every case, delineated in the drawings, sensor locations and details regarding their installation will be known to those familiar with the design and operation of steam turbine-generators. For utmost reliability, the analog input signals are redundantly provided.

Analog input interface 32 includes an isolation amplifier system 57 to act as a buffer between the analog input signal sources and signal processing circuitry so that loading and signal degradation effects are avoided. Sets of analog-to-digital converters are utilized for converting the analog input signals to digital signals compatible with computer processing. Included are A/D converters 59 for high level signals and A/D converters 58 for lower level signals. Although illustrated as single blocks, converters 58 and 59 provide separate channels for each analog input, there being one A/D converter for each analog input signal. Each A/D converter includes a latch (not specifically shown) for temporary storage of the corresponding input data. From the latch, CPU 45 reads the input data as required by the program. Buffer/driver network 54 provides the interface between the computer bus system 46 and the A/D converter channels. The input transfer of data is therefore a programmed transfer under the control of CPU 45.

The shared memory 30 of FIG. 3 is a dual-port random access memory unit, the ports of which are connected to the input and calculations computer bus 46 and to the control computer bus 63 so that intercomputer communication and transfer of data is through shared memory unit 30. Both computers, the input and calculations computer 28 and the control computer 26, have read/write access to all locations within shared memory 30, so that data put into the memory 30 by either computer may be extracted by either computer. Shared memory 30, as well as other shared memory units described herein, may be of the type disclosed and claimed in U.S. Pat. No. 4,212,057, of common assignee with the present application. Program control is utilized to arbitrate access to portions of the shared memory so that neither computer may interfere with the others access to those data items which must be treated as an entity.

Figure 4:
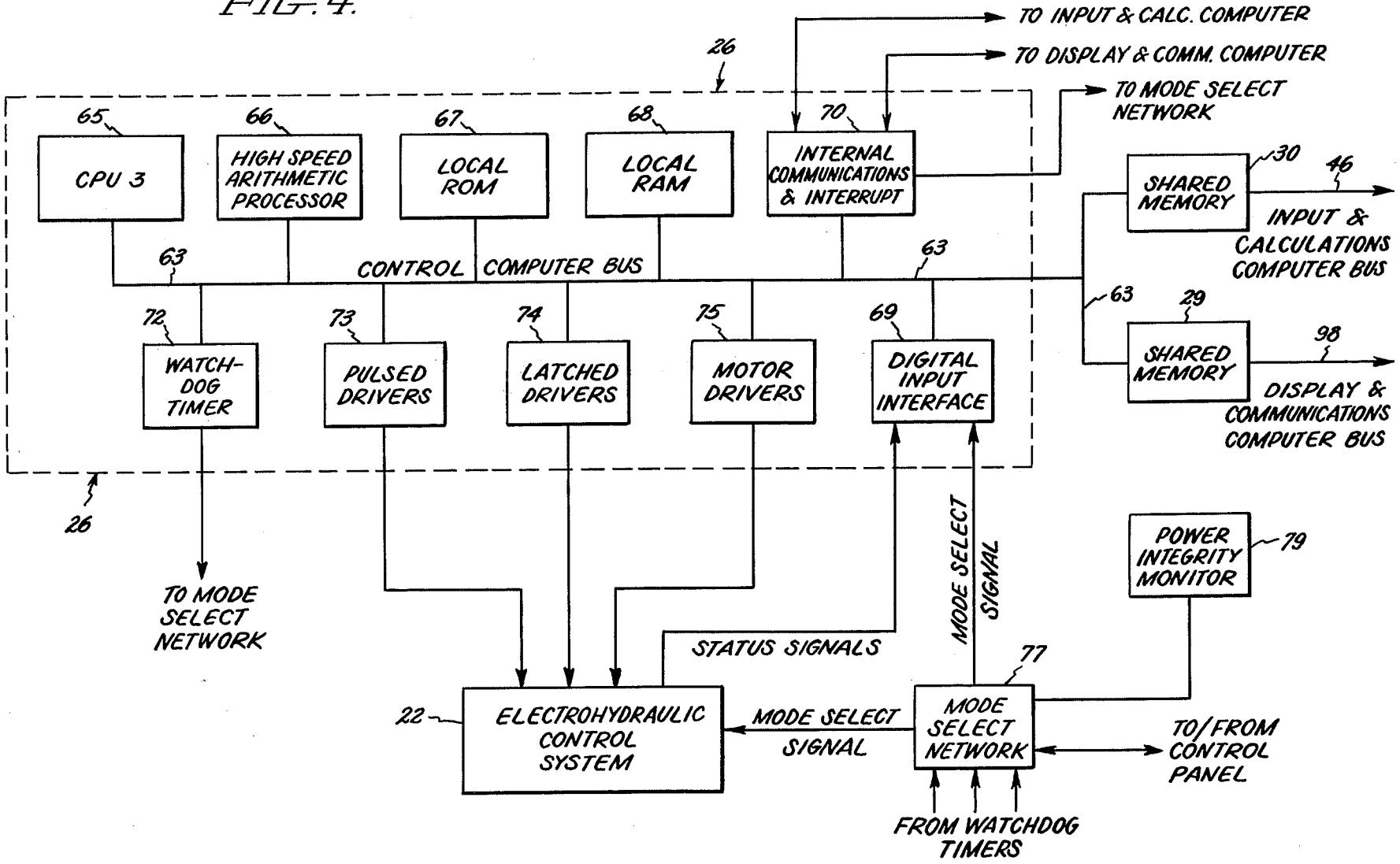
FIG. 4 is a block diagram further illustrating the control computer of FIG. 1 and including networks for interfacing the control computer to the electrohydraulic control system.

FIG. 4 further illustrates, in block diagram format, the control computer 26 of FIG. 1. The control computer 26 is a stored program digital microcomputer which includes a central processor unit (CPU) 65; a high-speed arithmetic processor 66; read only memory (ROM) 67; random access memory (RAM) 68; digital inpt interface 69; internal communications and interrupt network 70; watchdog timer 72; pulsed drivers 73; latched drivers 74; and motor drive network 75. A control computer bus 63 provides for the interconnection of elements comprising computer 26, and for the flow of digital signals including memory and other device address signals, data signals which may flow bidirectionally, and intracomputer control signals. Although illustrated schematically as one bus for simplification, and for the purpose of explaining the invention, separate busses are utilized for the different signals as is well known in the art. Bus 63 is additionally connected to shared memory units 29 and 30 through which programming information and data are shared between the control computer 26 and, respectively, display and communications computer 27 and input and calculations computer 28. Programs and subprograms executed by the control computer 26 are stored in ROM 67 according to the software architecture as given in control computer block 43 of FIG. 2. RAM 68 provides for interim storage of data.

With continued reference to FIG. 4, the control computer 26 directs and controls the electrohydraulic control system 22 through pulsed drivers 73, latched drivers 74, and motor drivers 75, and although shown schematically as single blocks to best illustrate the invention, these drivers encompass the required number of circuits to provide a complete set of output signals as necessary for control of the EHC system 22 of FIG. 1. The pulsed drivers 73 provide output pulses of sufficient power and time duration to cause operation (e.g., incrementation, decrementation, latching) of devices such as relays located within the EHC system 22 to increment or decrement setpoints such as those provided for turbine speed and acceleration rate according to which those variables are controlled. Latched drivers 74 provide outputs which are either on or off for operation of those devices within the EHC system, such as indicator lamps, which require sustained application of power; and motor driver 75 provides outputs for driving setpoint motors within the EHC system 22, such as those for setting turbine load or for selecting the steam admission mode. Each of the drivers 73, 74, and 75 is under control of CPU 65 in accord with program execution. It is to be noted that drivers 73, 74, and 75 are described only for this preferred embodiment of the invention and they may be altered or eliminated entirely in other embodiments of the invention which accommodate electrohydraulic or analog control systems of other types.

To keep the control computer 26 apprised of the operating status of the EHC system 22, digital signals indicative of such status are returned to the control computer 26 through a digital input interface 69. The status of the EHC system 26 includes its particular mode of operation which, for operation in conjunction with the present invention, includes a remote control mode so that supervisory control from the control computer 26 as described above can be effected. The digital status signal may be a digital word whose bit pattern describes the status of the EHC system 22. Digital input interface 69 also accepts digital signals from mode selector 77 through which the operating mode of the supervisory control system 25 is effected. The mode selector 77 accepts, from each watchdog timer of the system, signals which are indicative of the corresponding microcomputer's status. In the event of a microcomputer malfunction, as detected by any one of the system's watchdog timers, the mode selector 77 responds by directing the EHC system 22, the control microcomputer 26, and the entire system thereby, into a safe operating mode. The mode selector 77 is interfaced to the control computer bus 63 through digital input interface 69 and is also in two-way communication with the operator control panel 37 of FIG. 1 so that operating mode changes can be effected by operating personnel, and so that those changes mandated by the mode selector 77 can be announced to operating personnel. Power integrity monitor 79, also shown in FIG. 4, provides a continuous monitor on all system power supplies (not specifically illustrated in the drawings) and alerts the mode selector 77 of any impending source failure. The mode selector 77 responds by sending signals to the EHC system 22 and the supervisory controller 25 (through input interface 69) to force both into safe operating modes.

Figure 5:
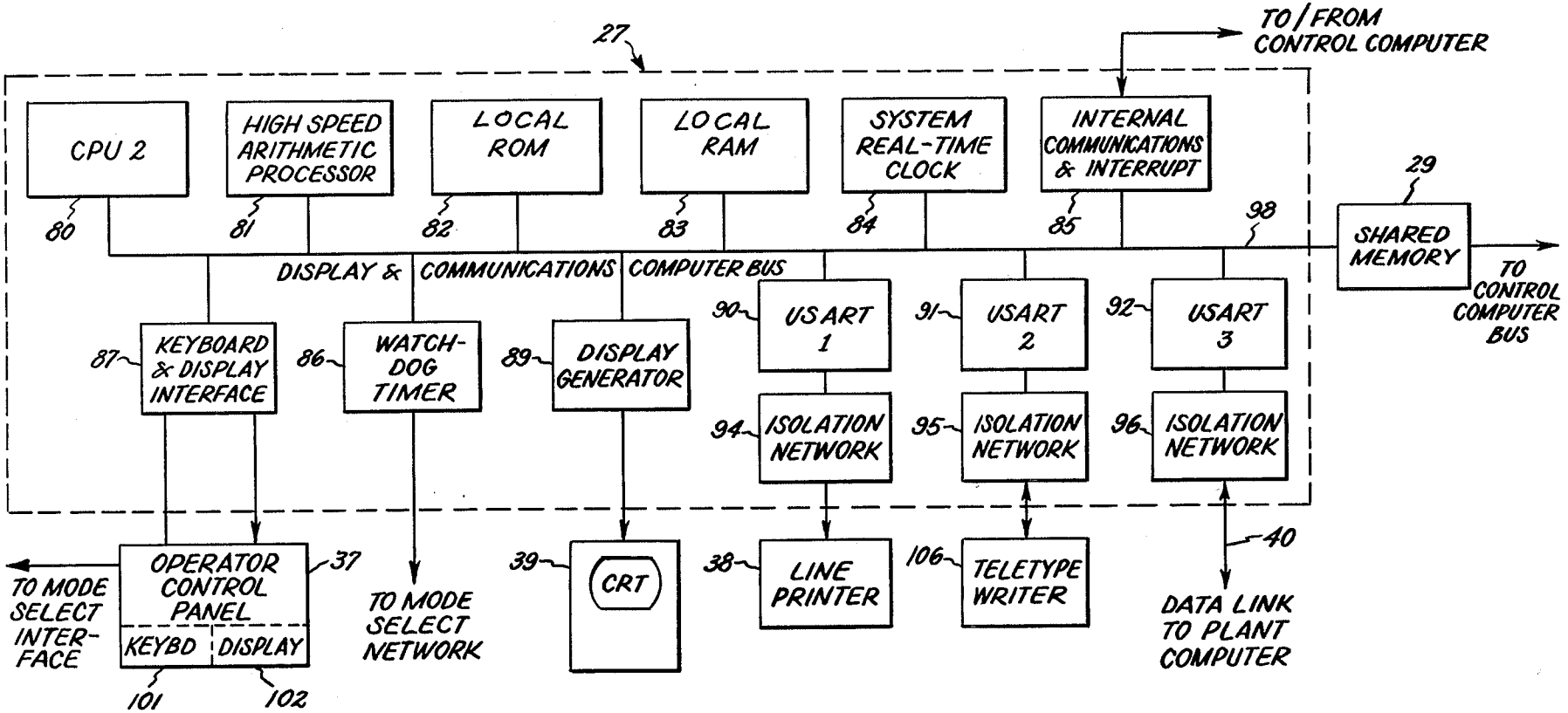
FIG. 5 is a block diagram further illustrating the display and communications computer of FIG. 1.

FIG. 5 shows in block diagram format the display and communications computer 27 in FIG. 1. This computer 27 is a stored program digital microcomputer including central processor unit (CPU) 80; high-speed arithmetic processor 81; read only memory (ROM) 82; random access memory (RAM) 83; system real time clock 84; internal communications and interrupt network 85; watchdog timer 86; keyboard and display interface 87; display generator 89; universal synchronous-asynchronous receiver-transmitters (USART) 90, 91, and 92; and associated isolation networks 94, 95 and 96. The program steps of the display and communications computer 27 are executed by CPU 80 to carry out the computer's assigned functions. The permanent steps of the program are stored in ROM 82, with scratch-pad memory provided by RAM 83. Exchange of program information and data between the display and communications computer 27 and the control computer 26 is through dual port, shared memory unit 29 with control, interrupt, and clock signals exchanged between computers being handled by internal communications and interrupt network 85. Clock 84 provides timing pulses for CPU's of all of the microcomputers comprising the supervisory controller 25. A display and communications computer bus system 98 provides interconnection of those elements comprising display and communications computer 27, and perferably includes separate busses for address signals, data signals, and control signals in accord with the requirements of the CPU 80 and other system components. Bus system 98 is, in all essential details, identical to those bus systems previously described.

The display and communications computer 27 provides for interaction with operating personnel; allowing the operator to enter control commands and data and to receive information (including requests for commands or data) regarding operation of the turbine-generator set. Operator inputs are made by way of operator control panel 37 which includes keyboard 101, numerical display unit 102, and (not specifically shown in FIG. 5) indicator lamps and selector switches. The control panel 37 is interfaced to the display and communications computer 27 through a keyboard and display interface 87 which preferably includes microprocessors separately devoted to the task of handling the flow of signals between the operator control panel 37 and the display and communications computer 27. Data and messages are presented to the operator on the cathode ray tube (CRT) unit 39, or in permanent hard-copy format by a line printer 38. The CRT 39 is coupled to the display and communications computer bus 98 through a display generator 89 which converts coded information derived from the display and communications computer 27 to corresponding messages for presentation to the operator on the CRT 39. Display generator 89 may, for example, be of the type manufactured and sold by the Aydin Controls Co. as Model 5215. Operator output is provided additionally through teleprinter 106. The peripheral devices, including printer 38, teleprinter 106, and data link 40, are interfaced to the display and communications computer through USART's 90, 91, and 92 which are large-scale integrated circuit devices well known to those of ordinary skill in the art for use in converting information handled in either a bit-parallel or bit-serial format to the alternate form. Such conversions, in the present invention, are required for intercommunication between the display and communications computer 27 and peripheral devices such as printer 38, teleprinter 106, and, via data link 40, with a plant computer. Isolation networks 94, 95, and 96 are buffers between corresponding peripheral devices and USART's 90, 91 and 92 to prevent loading and degradation of the signals being transferred.

Figure 6:
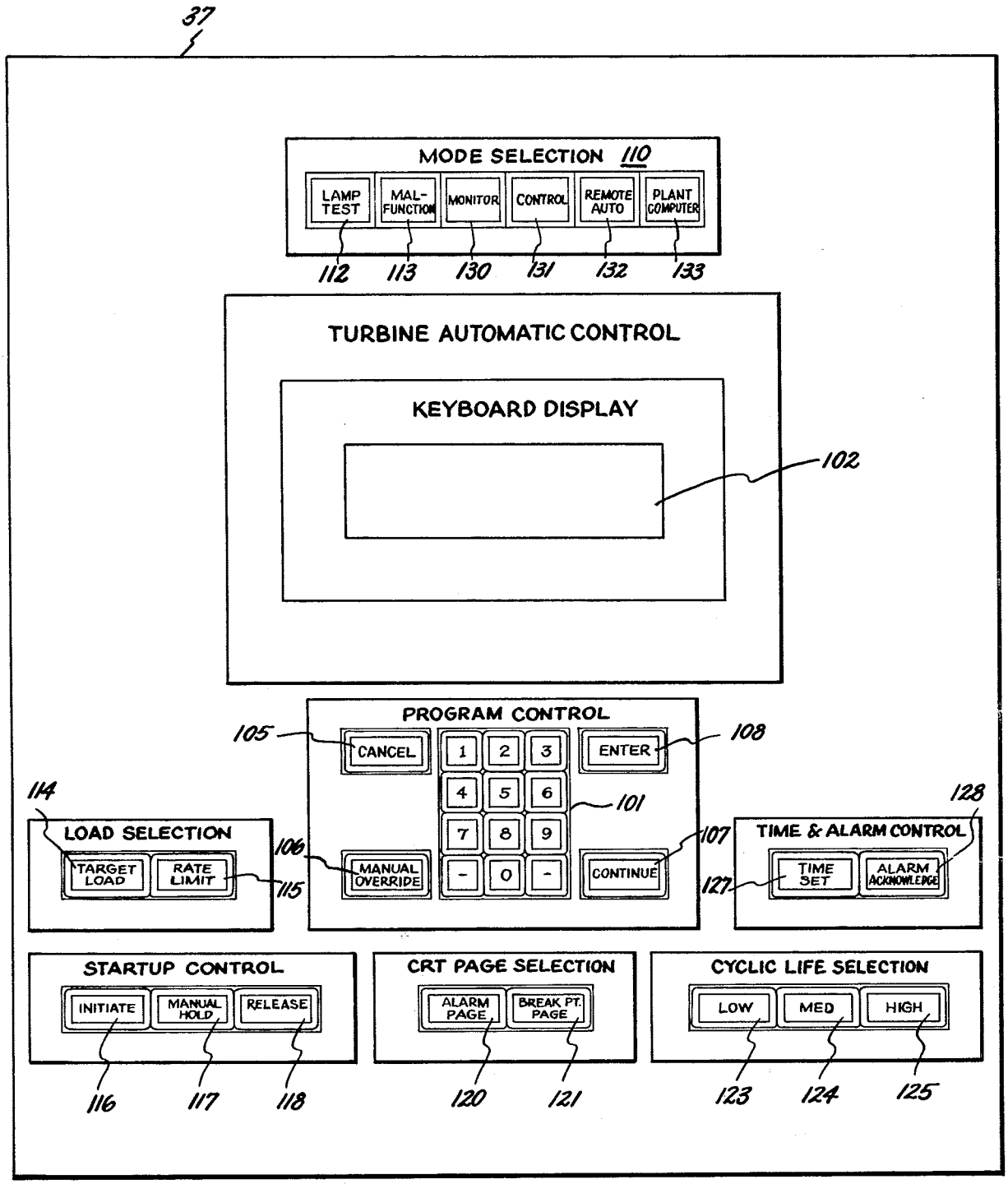
FIG. 6 is an illustration of an operator control panel adapted for use with the control system of FIG. 1.

A suitable control panel 37 through which an operator may interact with the control system 25 of FIG. 1 is illustrated in FIG. 6. The control panel 37 includes an alpha-numeric display 102 by which operator commands and other data, entered through keyboard 101 for program control (and ultimately control of the turbine-generator) may be displayed and corrected prior to entry into the control system 25. Associated with the keyboard 101 are pushbutton type switches for program control. These include cancel switch 105 by which a displayed quantity may be cancelled prior to being entered; a manual override switch 106 to allow a program hold (which may be related to a turbine operating parameter) to be overriden; and an enter switch 108 to transfer displayed values into the control system 25. Affirmation by the operator that the turbine is properly conditioned to be accelerated is expressed through continue switch 107. In essence, continue switch 107 provides an override of a halt built into the turbine startup routine to prevent the turbine from being accelerated off turning gear without operator acknowledgement.

The control panel 37 further comprises a bank of indicator-selector switches 110 which allows one of the various operating modes of the controller 25 to be manually chosen; a lamp test pushbutton 112 which may be actuated to test all other indicator lamps on the panel 37; and a malfunction indicator 113 for indicating a malfunction within the control system 25. For selection of a target load and a loading rate to reach the selected target load, target load switch 114 and rate limit switch 115 are provided. These switches alert the supervisory controller 25 that either a target load or a rate limit, as appropriate, is to be selected. The selection is then made through keyboard 101, display unit 102, and enter switch 108. Startup controls include initiate switch 116, which is used to initiate a turbine startup sequence, manual hold switch 117, to impose a hold on the turbine startup, and release hold switch 118. CRT page selectors include alarm page switch 120 and break point page switch 121. These switches, 120 and 121, provide for changing the "page" of information displayed on CRT 39. In particular, alarm page switch 120 is actuated to bring to the screen of CRT 39 a listing of parameters being monitored for alarm purposes and to show the status of those parameters. The alarm page may be changed to show a different set of alarm parameters by continued actuation of alarm page switch 120, keyboard 101, display unit 102 and enter switch 108. Break point page switch 120, on the other hand, changes the CRT display so that information is presented which pertains to a particular operating phase of the turbine-generator, e.g., preparation for rolloff. Switches for selecting the allowable expenditure of turbine rotor life during non-steady state operating phases of the turbine include low, medium, and high selector switches 123, 124, and 125. This set of swiches 123, 124 and 125 provides for manual selection of stress limits which may be imposed on the turbine during an operating phase in which cyclic stress will occur, e.g., during a turbine startup. Time and alarm control switches include time set switch 127 and alarm acknowledge pushbutton 128. Time set switch 127 sets the time frame of the control system 25 to synchronize with actual time of day so that data reported from the controller 25 are accurately made with respect to time. Alarm acknowledge switch 128 allows the operator to acknowledge to the controller 25 that an alarm has been recognized. The mode selector bank 110 comprises a monitor switch 130, a control switch 131, a remote auto switch 132, and a plant computer switch 133. These switches 130–133 allow the operating mode of the controller 25 to be manually selected and indicated. The control panel 37 is preferably located in close proximity to the control panel of the EHC system 22 so that an operator is in close touch with both the control system 25 and the EHC system 22.

2. Operating Modes

The control system structure of the present invention as illustrated in FIGS. 1–6 and as described above has a plurality of operating modes which are coordinated with various operating modes provided on the associated feedback control system such as electrohydraulic controller 22 of FIG. 1. For example, EHC controller 22 is preferably of the type having a manual mode, a supervisory remote mode, a remote load control mode for load control by an automatic dispatching system (ADS) or a coordinated boiler control system (CBC), and a standby mode. It will be readily apparent to those skilled in the art that an electrohydraulic controller not specifically including these modes may be adapted to provide them.

Operating modes of the supervisory controller 25 of the present invention include a monitor mode, a control mode, a remote automatic mode, and a plant computer mode. These modes are a result, principally, of the programmed coordination of the separate micro-computers of the supervisory controller 25, but certain items of hardward, including the mode selector 77 of FIG. 4 and the mode selection switches 110 of the control panel 37 of FIGS. 1 and 6, are necessary for implementation.

Mode selection in the EHC controller 22 is compatible with mode selection in the supervisory controller 25 and selection of incompatible modes is inhibited. Because the EHC controller 22 has direct control of the turbine-generator, activation of a particular mode (as by operator selection) within the EHC controller 22 prevails over mode selection in the supervisory controller 25. For example, changing the EHC mode from remote to manual forces the mode of the supervisory controller 25 to change from a control mode to a monitor mode. It will be recalled from the discussion above in connection with FIG. 4 that signals indicative of the mode, or status, of the EHC system 22 are generated within the EHC system and presented to the supervisory controller 25 through digital input interface 69 of FIG. 4. The control computer 26 handles the status of signals in accord with its program and places the supervisory control system into a mode compatible with that of the EHC system. Mode selection is summarized in the following table:

| | | EHC MODE | | | |
|---|---|---|---|---|---|
| | | Manual | Supervisory Remote | Remote Load Control | Standby |
| Supervisory Controller Mode | Monitor | Operator directs EHC. Supervisory controller monitors turbine, alarms abnormal conditions. | Inhibited | Load Control by ADS/CBC through EHC. Supervisory controller monitors turbine-alarms abnormal conditions. | Operator directs EHC. Supervisory controller monitors turbine, alarms abnormal conditions. |
| | Control | Inhibited | Supervisory controller in control-optimally directs turbine through EHC. | Inhibited | Inhibited |
| | Remote Auto. by ADS or CBC | Inhibited | Load Control by ADS/CBC. Supervisory controller in control of other parameters. | Inhibited | Inhibited |

-continued

| | EHC MODE | | | |
|---|---|---|---|---|
| | Manual | Supervisory Remote | Remote Load Control | Standby |
| Plant Computer | Inhibited | Supervisory controller in control. Inputs accepted from plant computer. | Inhibited | Inhibited |

Selection of an overall operating mode ordinarily begins by making a selection on the EHC controller 22. With the EHC system 22 in either the manual mode, the remote load control mode, or the standby mode, control is conventional and the only mode available to the supervisory controller 25 is the monitor mode as indicated in the above table. In this mode the supervisory system will guide an operator through all phases of turbine operation, providing information on turbine operating conditions, alarming those conditions which become abnormal, and generally providing the opertor with information so that he can set the EHC controller 22 for the most efficient and economical turbine-generator performance.

With the supervisory controller 25 in any of its remaining modes, i.e., the control mode, the remote auto mode or the plant computer mode, all modes of the EHC system 22 except the supervisory remote mode are inhibited. In the control mode (selectable through switch 131 of the control panel 37 of FIG. 6) the supervisory controller assumes control of the turbinegenerator so that only minimal intervention is required from an operator in automatically starting and loading or unloading to and from a so-called target load. Following synchronization of the generator frequency to the power line, and having reached the target load, the turbine load control can be turned over to a centralized load dispatch system such as ADS or CBC. Alternatively, inputs can be accepted from a plant computer to provide coordination of the controlled turbine-generator with all other plant equipment, including other turbine-generator sets. An automatically controlled turbine startup will proceed as follows.

A startup sequence is initiated from the operator control panel 37 of FIGS. 1 and 6 by initiate switch 116. The control system proceeds then in logically arranged steps beginning with rotor prewarming. During the rotor prewarming step the supervisory controller 25 determines the turbine rotor bore temperature at three locations, announces these temperatures to the operator, and indicates whether rotor prewarming is required before turbine roll-off can take place. Progress of rotor prewarming and other phases of the startup are monitored and described on the CRT 39. next a determination is made as to whether chestwarming is required. If so, the operator is advised by a appropriate message on the CRT 39. When satisfactory chestwarming is achieved this will also be announced. When satisfactory chestwarming and rotor prewarming have been achieved, the next step is preparation for roll-off. However, either the plant computer or the operator may, at any point, impose a hold on the startup procedure. The operator imposed hold is by manual hold switch 117 located on the control panel 37. The hold is removed by release hold switch 118. As preparation for roll-off begins, the operator will be requested by the controller to select an allowable level of cyclic life expenditure (CLE) for that particular startup. Operator selection of CLE is expressed through high, medium, and low cyclic life selection switches 123, 124, and 125.

Preparation for roll-off includes checks for validity of calculations made, that boiler steam is of satisfactory condition, and that no unacceptable alarms or operator overrides exist. If the results of these checks are satisfactory, the turbine rotor is rolled free of the turning gear by increasing the admission of steam and a first target speed and acceleration rate are dictated to the EHC system by the supervisory controller. When the first target speed has been reached, a determination is automatically made as to whether to proceed to a second, higher target speed or to hold momentarily until sufficient warming of the turbine and stress reduction have occurred. In any case, intermediate target speeds and acceleration rates are selected and set until synchronous speed has been reached.

At a time prior to reaching synchronous speed, an external generator field excitation system is activated and generator output voltage is matched to the power system voltage. With field excitation applied, a proper voltage match, and with the turbine at line speed, the supervisory controller announces to the operator that synchronous conditions are achieved and holds until synchronization has been achieved by the operator or by an automatic synchronizer activated by the supervisory controller 25.

Immediately following synchronization, the turbine is automatically loaded to a minimum load and either held there or advanced toward a higher target load at an optimum rate as determined by turbine temperatures and rotor stress. Target load and maximum allowable loading rate are selected by the operator through target load switch 114 and rate limit switch 115, both illustrated in FIG. 6.

During the turbine startup sequence and after achieving steady-state operation at some desired load level, the most favorable steam admission mode-either full arc or partial arc-is automatically selected to operate and position the control valves. This automatic selection of the most favorable steam admission mode produces uniform heating of the turbine, minimizes rotor stress during startup and initial loading, and achieves the high efficiency of partial arc admission during the bulk of the turbine operating time. The admission mode most favorable under the prevailing conditions is automatically determined by the supervisory controller 25, and then, acting through motor drive network 75 as illustrated in FIG. 4, a drive motor or other positioning device within the EHC system is activated to select the desired admission mode. The most favorable admission mode selection is carried out in the present invention in accord with the methods and teachings of U.S. Pat. No. 3,561,216 to J. H. Moore, Jr., and in accord with the methods disclosed in U.S. Patent application Ser. No. 145,219 for "Method And Apparatus For Thermal Stress Controlled Loading Of Steam Turbines," assigned to the assignee of the present invention. The disclosure of each is incorporated herein by reference thereto. Apparatus particularly well suited for control of admission mode within an EHC system and for interfacing with the present invention is that disclosed in U.S. Pat. No. 4,177,387, incorporated herein by reference thereto.

Once the target load is attained, the operator can turn load control of the turbine over to a central load dispatch system or to a coordinated boiler control system by switching to the remote automatic mode. In the remote automatic mode the supervisory controller 25 remains as a monitor and retains control of the steam admission mode and other control parameters to ensure that the turbine is not overstressed.

In the plant computer mode of operation the supervisory controller 25 is used in conjunction with a large, external, mainframe type computer. In the computer mode, the controller 25 either supplies data to the plant computer regarding turbine operation, or receives from the plant computer inputs which operating personnel would otherwise supply. Examples of such inputs include target loads, allowable cyclic life expenditures, and operating holds. The exchange of information between the supervisory controller 25 and the plant computer is solely via data link 40 as illustrated in FIGS. 1 and 5.

3. Program Structure and Intercomputer Communications

The microcomputers comprising the controller of the present invention are independent subsystems with intercomputer communictions and coordination of functions being carried out through the use of dual port read/write memory units 29 and 30 as schematically illustrated in FIGS. 1 and 3–5. The use of dual port, shared memory units has been fully disclosed in the above-mentioned U.S. patent application Ser. No. 679,408 filed Apr. 22, 1976 and of common assignee with the present application, the disclosure of which is incorporated herein by reference thereto. The memory units 20 and 30 may also be referred to herein as shared memories. The microcomputer hierarchy is structured for communications between the control computer 26 and the input and calculations computer 28, and between the control computer 26 and the display and communications computer 27, but without direct communication between the display and communications computer 27 and the input and calculations computer 28.

Figure 7:
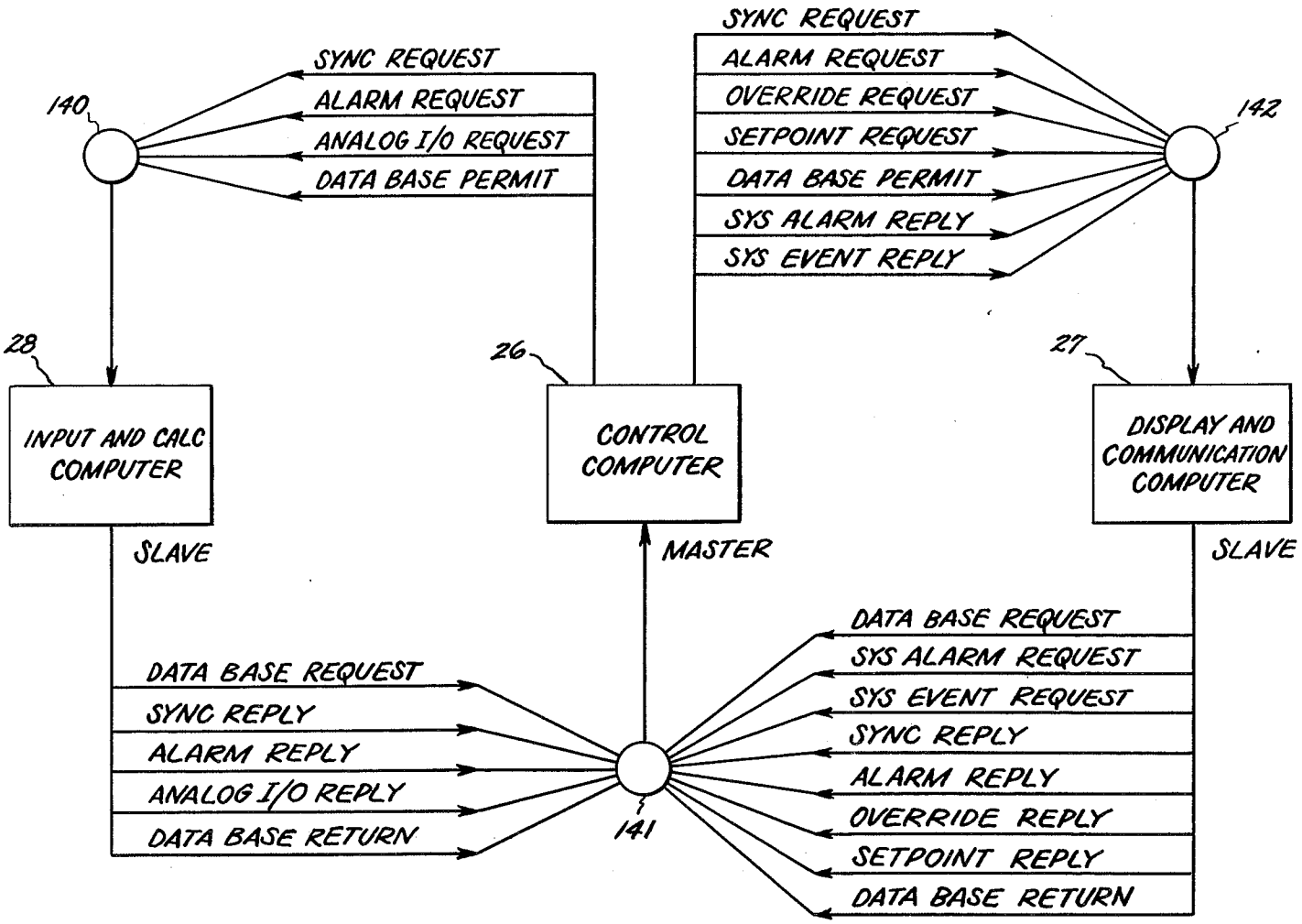
FIG. 7 is an intercomputer message flow diagram for the microcomputer hierarchical arrangement of FIG. 1.

Included in the program of each microcomputer 26, 27, and 28 is a subprogram, or software task, for supervision of interprocessor communication which, in conjunction with corresponding internal communications and interrupt networks 70, 85, and 51, controls the exchange of messages necessary for coordinated operation. Such messages include requests for data, replies thereto, and synchronization signals. Each microcomputer 26, 27, and 28 generates and recognizes interrupt signals which are used to alert the receiving computer to an incoming message or to a change in status of the transmitting microcomputer. Coded flag words are used to determine the meaning of an interrupt. For example, one flag word is used to control transmission to the remote, or receiving microcomputer while a second flag word controls reception from the remote microcomputer. The reception flag word may be coded by the receiving microcomputer to indicate "clear to send;" the transmission flag word may be coded to indicate that a message must be copied and posted at an appropriate memory exchange location for subsequent access by the receiving microcomputer. The transmission flag word is further coded to acknowledge receipt and dispatch of the message. FIG. 7 is an intercomputer message flow diagram depicting the three independently operating microcomputers 26, 27, and 28 and the routing of messages through generalized memory exchange locations 140, 141, and 142.

Figure 8:
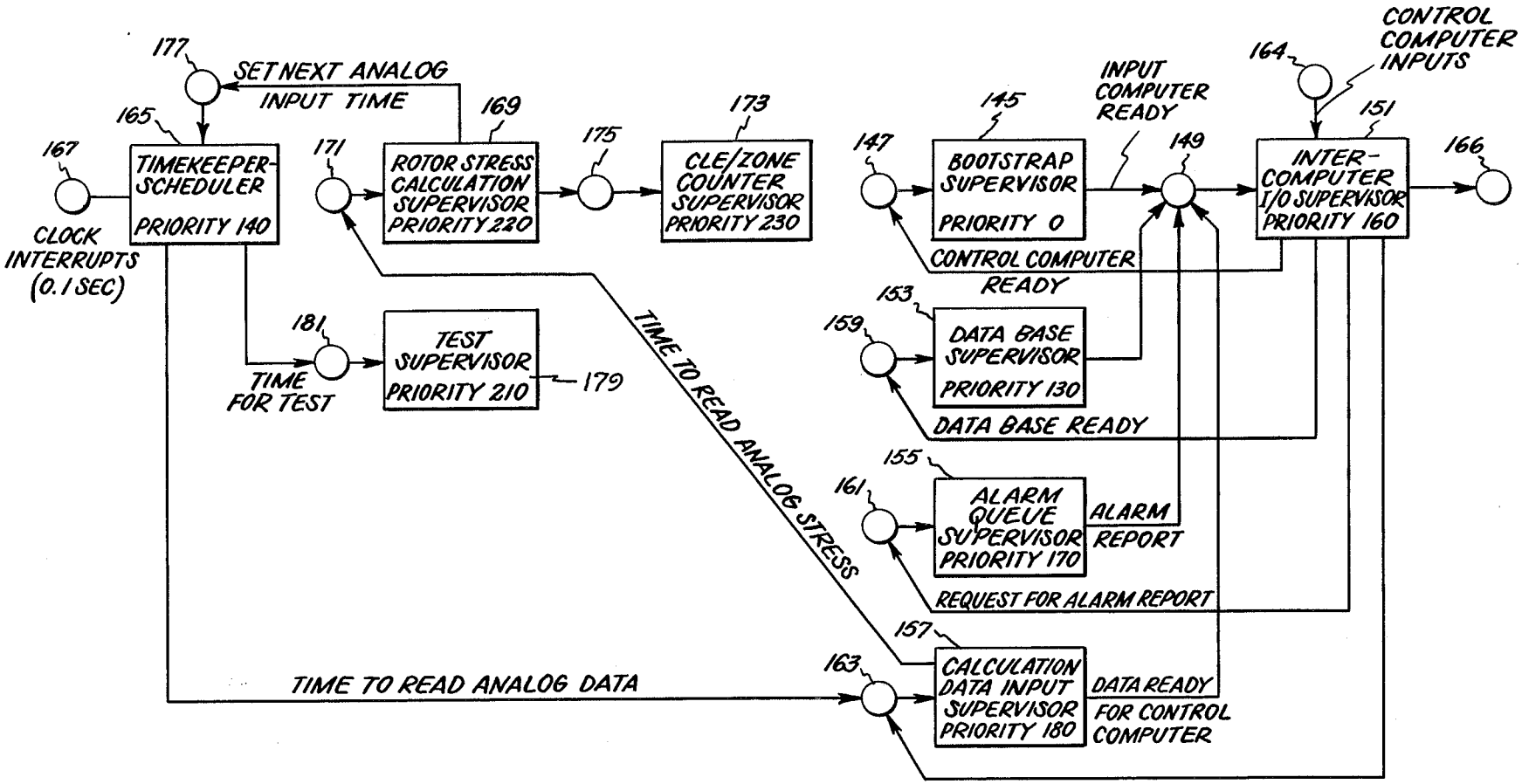
FIG. 8 is a program structure and message flow diagram for the input and calculations computer of FIGS. 1 and 3.

FIG. 8 illustrates the program structure for the input and calculations computer 28, and shows the strategy by which the subprograms, or tasks, comprising the program for the input and calculations computer 28 are executed, and further illustrates the use of memory exchange locations for deposition and retrieval of messages according to which the various tasks are called for execution. In FIG. 8 (as well as in following FIGS. 9 and 10) rectangular boxes represent subprograms, or tasks, executable within the input and calculation computer 28 and which are stored in ROM 47 of FIG. 3; circles represent memory exchange locations which may be located either in RAM 48 or in shared memory unit 30, both of which are illustrated in FIG. 3; arrowed lines indicate message flow direction, and numbers given within the task boxes show relative priority of task execution, lower numbers being used to indicate higher priorities. Thus there are nine major software tasks executable by the CPU 45 of the input and calculations computer 28. These tasks are executed concurrently, meaning simply that CPU 45 does not perform the tasks sequentially nor simultaneously, but rather executes as much of a subprogram as possible until there is an interruption by another subprogram of higher priority. As interruptions occur, execution of the first subprogram is suspended until the higher priority subprograms, are completed. All subprograms may run concurrently in this fashion.

Still referring to FIG. 8 in conjunction with FIGS. 1 and 3–5, bootstrap supervisor subprogram 145 brings the input and calculations computer 28 into a state of readiness upon a reset of the microcomputer hierarchy and upon power-up. The bootstrap subprogram 145 receives input informtion through generalized exchange location 147 that the control computer 26 is ready. Once the input and calculations computer 28 is initialized, a message is posted to that effect at exchange location 149 for intercomputer input/output subprogram 151. It is to be reiterated that meassage exchange locations as illustrated and described do not represent specific memory locations but are constructs representing accessible memory loctions through which information flows to and from various subprograms. The interprocessor I/O supervisor subprogram 151 is thus additionally interrelated with the data base supervisor 153, the alarm queue supervisor 155, and the calculation data input supervisor 157, calling upon these subprograms through, respectively, exchange locations 159, 161, and 163. Each subprogram 153, 155, and 157, in addition to bootstrap supervisor 145 reports back to the intercomputer I/O supervisor 151 through exchange 149. Interrupts and inputs from the control computer 26 are posted through exchange 164 while outputs to the control computer 26 are posted through exchange location 166.

A timekeeper/schedule subprogram 165 accepts regular timing inputs from the real time clock (shown in FIG. 5) through exchange location 167 and in turn puts out regularly scheduled requests for execution of the calculation data input supervisor subprogram 157 to read in analog data pertaining to the turbinegenerator. Analog input data is converted to digital format and validated through software modules comprising the input supervisor subprograms 157 which, at the proper time, keys the rotor stress calculation supervisory subprogram 169 by posting a message at exchange location 171. The rotor stress calculation subprogram 169 provides a determination of turbine rotor stress according to methods taught by above-mentioned U.S. Pat. Nos. 3,446,224, 4,046,002 and 4,104,908. Once the stress calculations are complete for a particular measurement cycle, stress and cyclic life counters 56 (as indicated in FIG. 3) must be updated to reflect the current status. It will be recalled, from descriptions given above, that incidents of turbine stress are of two types, cyclic life expenditure (CLE), and stress with respect to FATT. Subprogram CLE/Zone counter supervisor 173 provides the software control for operating the digital counters 56 which accumulates data on these high-stress events. In the case of CLE, counters are provided for both the HP and IP turbine rotors, providing numerical readouts indicative of the accumulated percentage of rotor cyclic life expended; for stress incidents with respect to FATT, zones of potential risk are established based on temperature and rotor bore stress, and counters representing the zones are incremented for each excursion of stress into a corresponding zone. Signals to update the stress and cyclic life counters 56 are posted to the CLE/Zone counter subprogram 173 through exchange 175; signals to set the next analog input time are posted to the timekeeper/scheduler 165 through exchange location 177.

Periodically, the input and calculations computer 28 is put through a self-test procedure to provide the earliest possible indication of a malfunction within the computer 28 itself. This self-test is under the diection of test supervisor subprogram 179 which is activated by signals posted at exchange 181 by the timekeeper/scheduler 165. Unless the results of the test procedure are favorably reported, the watchdog timer (illustrated in FIG. 3) for the input and calculations computer 28 will fail to be updated. This, in turn, will result in a malfunction of the computer 28 being indicated to the operator and the supervisory controller and the EHC system 22 automatically being returned to the monitor and manual mode, respectively.

Figure 9:
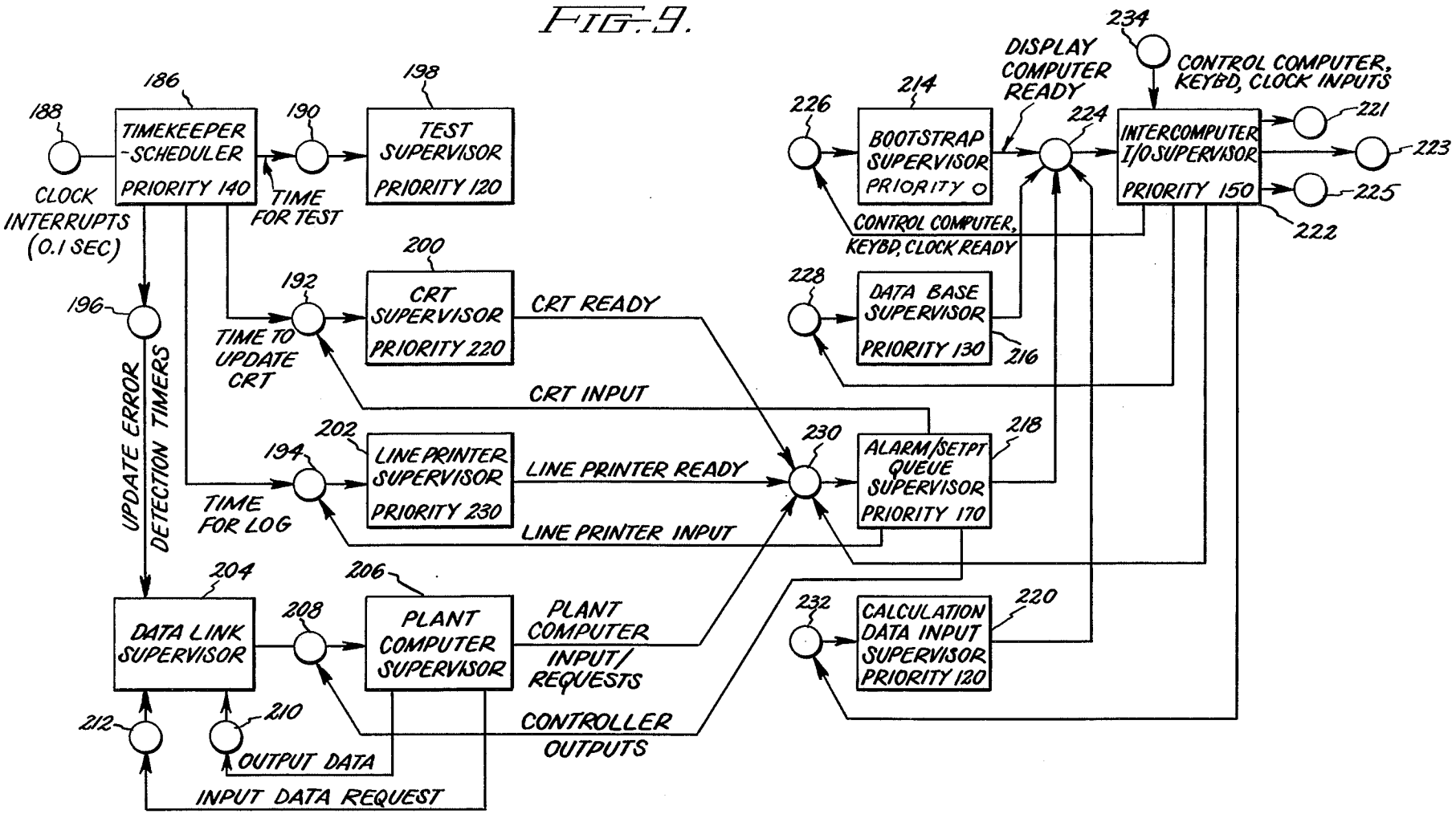
FIG. 9 is a program structure and message flow diagram for the display and communications computer of FIGS. 1 and 5.

FIG. 9 illustrates the program structure and flow of internal communications for the display and communications computer 27 of FIGS. 1, 5 and 7. The subprograms are executed according to the relative priorites indicated numerically in the subprogram boxes of FIG. 9. A timekeeper/scheduler subprogram 186 receives periodic clock interrupts from the real time clock 84 (shown in FIG. 5) through exchange location 188 and provides timing and scheduling of other tasks which are to be executed by the display and communications computer 27. On a periodic basis, the timekeeper/scheduler 186 posts messages at exchange locations 190, 192, 194 and 196 to activate, respectively, the test supervisor subprogram 198, the CRT supervisor subprograms 200, the line printer subprogram 202, and the data link supervisor 204. The test supervisor subprogram 198 is an on-line self-test routine which tests the functionality of the computer 28 which in turn must produce satisfactory results to update the computer's watchdog timer to avoid a malfunction indication being given to the operator and causing an automatic switch of the supervisory controller to the monitor mode and the EHC system 22 to manual operation. CRT supervisor subprogram 200 includes those software modules necessary to keep the CRT 39 updated with appropriate messages for proper operator guidance. The line printer supervisor 202 is periodically executed to control the line printer 38 and produce a permanent log of data pertinent to turbine-generator operation and a log of alarms and overrides produced by either operating personnel or the plant computer. Data link supervisor 204 in conjunction with plant computer supervisor subprogram 206 provides the software tasks which coordinate the use of the supervisory controller 25 with a larger mainframe-type plant computer. These software tasks are used principally when the controller 25 is operating in the plant computer mode. The plant computer supervisor subprogram 206 receives controller output data relative to turbine-generator operation and is activated through exchange location 208. Output data for the plant computer, and requests for data therefrom are handled by the data link supervisor 204 through exchange locations 210 and 212.

The program structure of FIG. 9 further includes bootstrap supervisor 214, data base supervisor 216, alarm/setpoint/queue supervisor 218, and calculation data input supervisor 220, all of which provide information to intercomputer I/O supervisor 222 through exchange location 224, and receive inputs from the intercomputer I/O supervisor 222 through exchanges 226, 228, 230, and 232, respectively. Output information for the control computer, the keyboard, and the clock is posted, respectively at locations 221, 223, and 225. Alarm/setpoint/queue supervisor 218 provides output data to CRT supervisor 200, to line printer supervisor 202, and the plant computer supervisor 206 as requested by these subprograms and as supplied to the alarm/setpoint/queue supervisor 218 by interprocessor I/O supervisor 222. Interprocessor I/O supervisor 222 receives inputs from the control computer 26, the operator control panel, and the system clock through exchange location 234. The exchange locations of FIG. 9 are memory locations in shared memory unit 29 of FIGS. 1 and 5, and in RAM 83 of FIG. 5.

In FIG. 10, which shows the program structure and software message flow for the control computer 26 of FIGS. 1, 4, and 7, a timekeeper/scheduler subprogram 235 provides periodic requests and synchronizing signals to activate other functional subprograms including data base supervisor 237, test supervisor 239, mode supervisor 241, loading rate supervisor 243, and steam admission mode supervisor 245. This software timing is based on periodic inputs from the clock 84 of FIG. 5 posted at exchange location 246. The mode supervisor subprogram 241, synchronized through exchange location 242, accounts for the operating mode of the supervisory controller and provides start and restart signals to the turbine-generator startup task 247 through input exchange location 249. the mode supervisor 241 also provides start/stop messages to the loading rate supervisor 243 and to the steam admission mode supervisor 245. Input messages from the timekeeper scheduler 235 and from mode supervisor 241 are posted to these subprograms, 243 and 245, through exchange locations 251 and 253. Test supervisor subprogram 239, activated through input exchange 256 puts the control computer 26 through an on-line test procedure to determine the operability of the computer 26 and thus provide the earliest indication of a computer malfunction. In the event the test procedure does not produce satisfactory results, watchdog timer 72 will be allowed to time out after which the supervisory controller is automatically put into the monitor mode, the operator is alerted of the apparent malfunction, and the EHC system is put into a manual control mode. The test supervisor subprogram works in conjunction with hardware items including watchdog timer 72 and the mode select network 77, both of FIG. 4.

The program structure of FIG. 10 further includes bootstrap supervisor 255, alarm event/queue supervisor 257, calculation data input supervisor 259, setpoint supervisor 261, and intercomputer I/O supervisor 263. Communication with the input and calculations computer 28 is via exchange locations 260 and 262; and with the display and communications computer 27 via exchange locations 264 and 266. Bootstrap supervisor 255 initializes the control computer 26 following application of operating power and provides for initial startup of the control computer 26. An indication that the control computer is ready is produced following the bootstrapping operation and is posted at exchange location 265 as an input message for intercomputer I/O supervisor 263. Data base supervisor 237 is periodically executed to update those areas of memory in which data pertaining to turbine-generator operation is stored by one software task and used in the performance of one or more other tasks. To prevent this data from being concurrently "read" by one subprogram while being "written" by another subprogram, data base supervisor 237 controls access to the data base. Alarm/event queue supervisor 257 records alarm message inputs from the three microcomputers 26, 27, and 28 of the control system. This task 257 also records startup (event) messages from the control computer 26 and override messages from the display and communications computer 27. On demand from the display and communications computer 27, the alarm/event supervisor 257 reports the contents of the queued messages. Calculation data input supervisor 259 is a subprogram for forwarding requests for analog input data to the input and calculations computer 28 and for returning the selected analog input values (converted to digital form) to the requesting subprogram in the control computer 26. The setpoint supervisor 261 processes and generates setpoint values, such as target load and loading rate, which are to be set into the EHC system 22 and provides updating thereof according to turbine operating conditions. Interprocessor I/O supervisor 263 directs the flow of information between the control computer 26 and the other two microcomputers, the display and communications computer 27, and the input and calculations computer 28.

Figure 11:
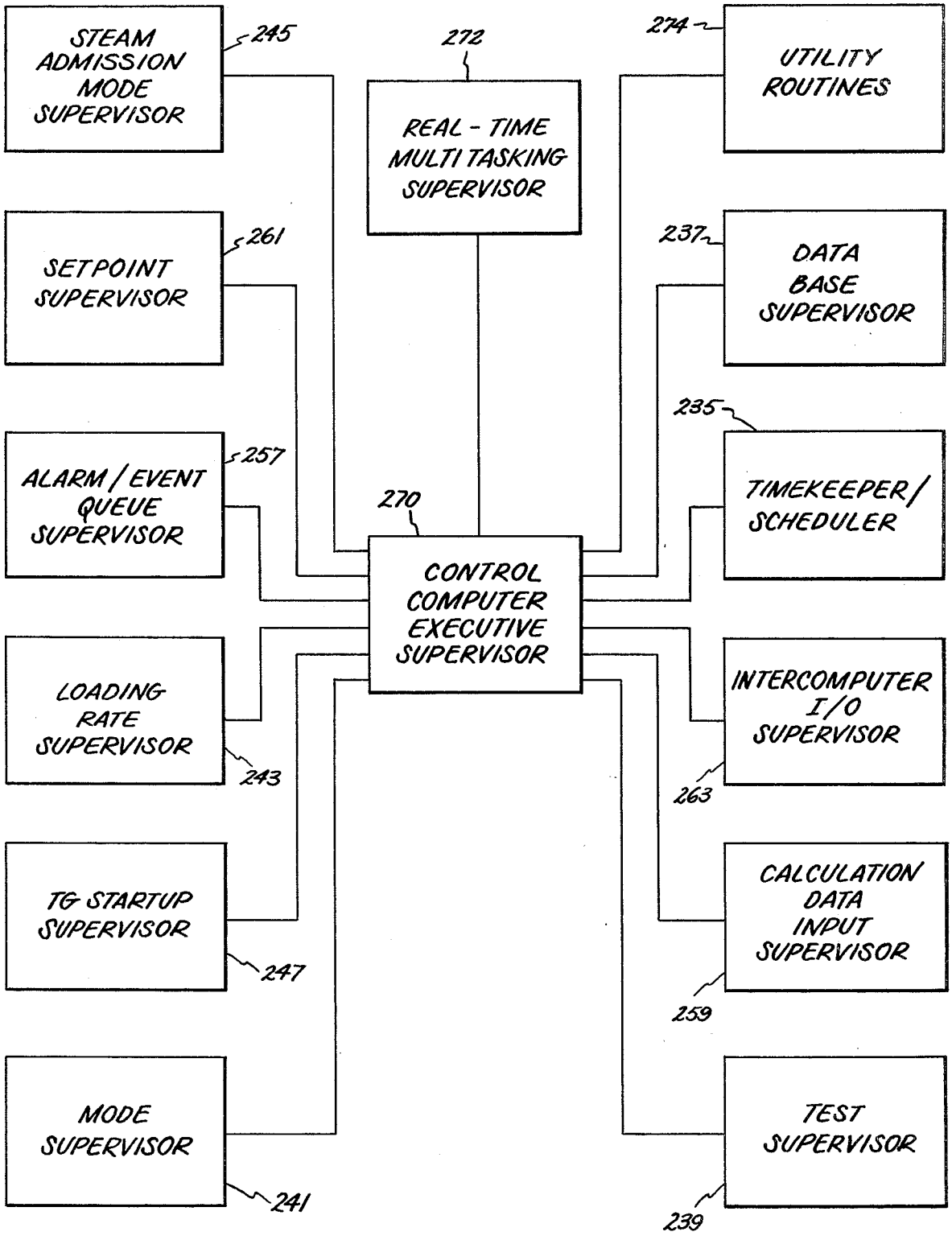
FIG. 11 is a block diagram illustrating the interrelationship between subprograms and an executive program for the control computer of FIGS. 1 and 4.

Resident in each of the microcomputers 26, 27, and 28 comprising the supervisory control system of the present invention is an executive program whose function is to supervise execution of the various subprograms within the particular microcomputer as described above in relation to FIGS. 8, 9 and 10. These executive programs allocate the microcomputer resources among the several subprograms to allow performance of computations and input/output in real time. FIG. 11 illustrates the interfacing of an executive program 270 for the control computer 26 to subprograms executable therein. The control computer executive program 270 draws upon and supervises execution of all of the subprograms illustrated in the program structure and message flow diagram of FIG. 10 (having identical reference numerals in FIG. 11), and in addition is interfaced with real-time multitasking subprogram 272 and utility routines subprograms 274. The real-time multitasking subprogram 272 is a general purpose supervisory program which enables performance of the other tasks/subprograms and is responsible for performing or controlling functions within the control computer including: (1) bootstrapping; (2) supervising subprogram execution according to relative priorities as established in FIG. 10; (3) handling interrupts; (4) input/output control; and (5) interprogram communications. The group of utility routines 274 supplies subroutines for performing calculations, data manipulations, and input/output operations of general use to the other subprograms of FIG. 11. Utility subroutines are also callable and executable by each of the other microcomputers of the hierarchy and the following table sets forth a listing of utility routines generally available within the hierarchy and briefly describes their purpose and function.

TABLE 1

| Subroutines | Purpose |
|---|---|
| Analog Inputs in a Sequential Order | Input of data from any number of analog points in a sequence. |
| Analog Inputs in any Sequence | Input of data from any number of analog points in any sequence. |
| Digital Input | Input of information coded as a set of bits. |
| Momentary Digital Output | Output of momentary digital signals - momentarily sets individual outputs when corresponding bit in the input data is set. |
| Latching Digital Output | Output of digital signals latched in either set or reset state. Sets individual outputs when a corresponding bit in the input is set and clears when reset. |
| Programmed Time Delay | Delay Continuation of a program. |
| Time of Day Reentry | Calculate reentry time based on a reference time and a time interval. |
| Synchronizing Time Delay | Delay continuation of a program until time synchronization can be achieved. |
| Time Conversion | Converts time units. |
| Time of Day | Determine current Time of Day. |
| Date | Determine Current Calendar date. |
| Inclusive OR<br>Logical AND<br>Exclusive OR<br>Logical Shift<br>Single Bit Test<br>Bit Set<br>Bit Clear<br>Circular Shift<br>Logical Not | Logic functions performed on 16-bit values. |
| Bit Extraction | Extract a field of bits of specified length, right justifying and filling unused bits with "0". |
| Data Base Control | Limit access to the data base to a single task. |
| Alarm Message Control | Signal alarm message to CRT, LPT, and plant computer. |
| Startup Breakpoint Message Control | Sent startup breakpoint message to CRT, LPT, and plant computer. |
| Event Message Control | Signal startup event messages to CRT, LPT, and plant computer. Set event override status to CRT, plant computer to "OVERRIDDEN", "NOT OVERRIDDEN", or "OPEN TO OVERRIDE". |
| Override Test | Determine which, if any, operator select overrides have been received. |
| Intertask Message Read/Write | Decode/Encode a formatted message. |

TABLE 1-continued

| Subroutines | Purpose |
|---|---|
| Intertask Massage Send/Accept | Send/accept a formatted intertask message through exchange location. |
| Intertask Message Wait | Wait for a formatted message at the exchange used by another task. |

Figure 12:
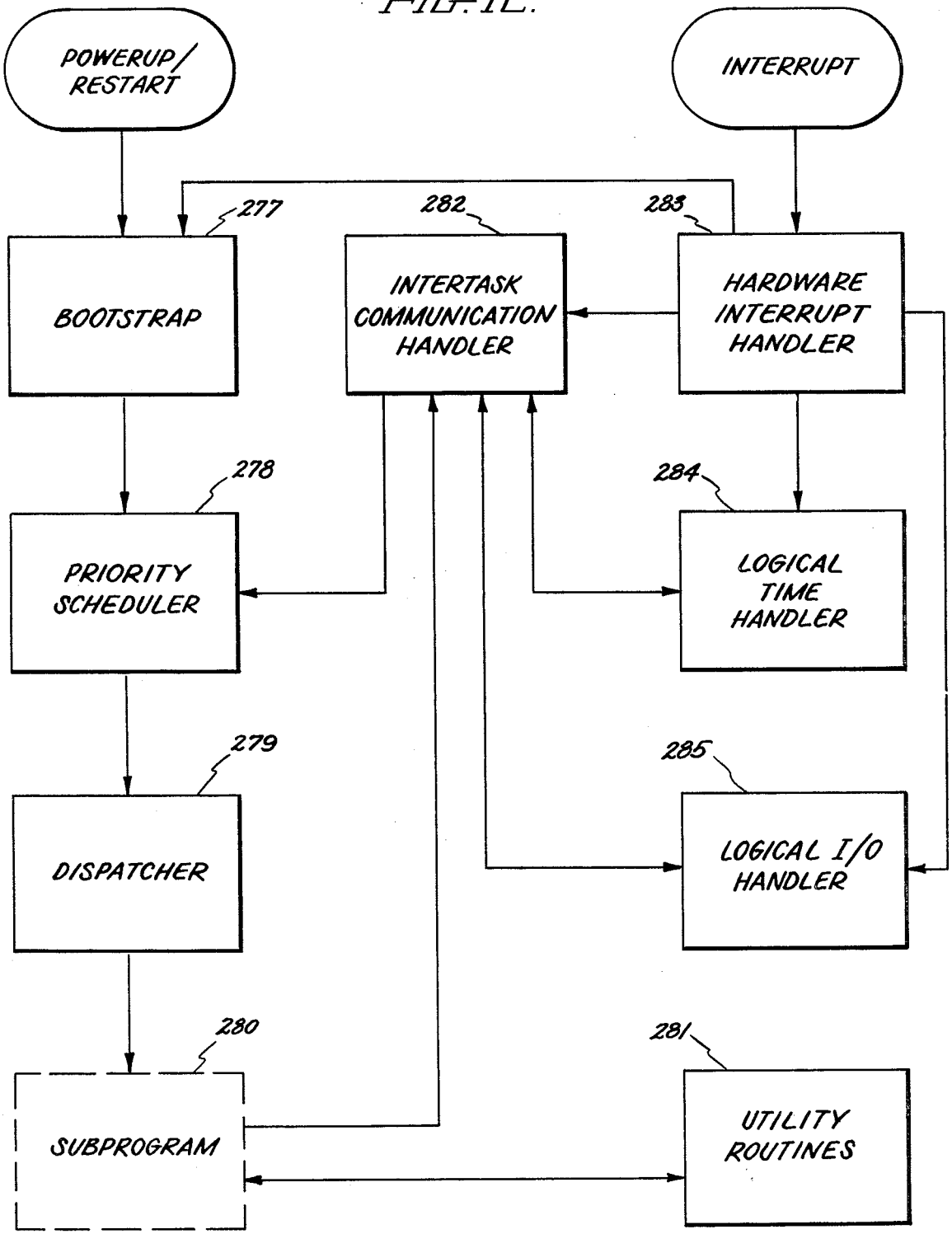
FIG. 12 is a block diagram depicting the major functional components of the executive program of FIG. 11 and illustrating interactions of those components.

The manner in which the executive program 270 of the control computer functions is illustrated in the block diagram of FIG. 12 in which blocks represent major functional components and other subprograms/tasks which are called upon by the executive program 270. Upon powerup or restart, the control computer is directed through a bootstrapping operation 277 which initializes read/write memories (RAM and shared memory), defines parameters unique to the particular turbine-generator being controlled, and initializes the control records of multitasking subprogram 272 of FIG. 11. Once the control computer 26 is bootstrapped to an operating condition, priority scheduler 278 schedules subprograms for execution (by CPU 65 of FIG. 4) based on the subprogram's priority. It will be recalled from the description of FIGS. 8–10 above, that each subprogram has associated with it a priority that indicates its importance relative to other subprograms in the system and relative to the interrupts of peripheral devices. Priority scheduler 278 assembles a list of subprograms ready to be run and selects for execution the highest priority subprogram on the list. The dispatcher 279 is responsible for bringing the CPU 65 of the control computer 26 into condition for program execution. The dispatcher 279 tests a subprogram's status and if the subprogram has been interrupted, the CPU 65 is restored to its condition at the moment the interrupt occurred. If the subprogram has not been interrupted, but instead has asked for a special service, dispatcher 279 loads the CPU 65 with data appropriate to the service rendered. There is then a program branch or return to the selected subprogram. The subprogram currently being executed is shown in dashed lines as block 280. Utility routines 281 as previously described and as listed in the above table are supplied to the subprogram being executed as that subprogram calls for them.

Still referring to FIG. 12, the intertask communication handler 282 provides for the interchange of information between subprograms and between subprograms and the executive program 270 of FIG. 11. Information flow is by way of exchange locations within read/write memory within which a list of tasks waiting for messages or a list of messages for a task can begin queuing. The intertask communication handler 282 adds incoming messages to the list and removes, on a first in, first out basis messages which can be accepted by a task (subprogram). If the task was waiting for the message, the intertask communication handler 282 causes the task to be placed on the list of tasks ready for execution. The intertask communication handler 282 also functions in conjunction with hardware interrupt handler 283, logical time handler 284, and logical I/O handler 285. The hardware interrupt handler 283 is responsible for controlling the interaction of hardware and software, i.e., the hardware/software interface. All interrupts originate outside the supervisory control system 25 and are generated to indicate that some external device, e.g., CRT or EHC system 22, is either ready to send data into the controller 25 or accept data therefrom. Upon receipt of an interrupt, the hardware interrupt handler 283 identifies the interrupt source, temporarily disables all subsequent interrupts, and performs the hardware operations required to acknowledge the interrupt. Depending on the interrupt priority, the hardware interrupt handler 283 passes control to the intertask communication handler 282 or to a specified interrupt service routine such as the logical time handler 284, or such as the logical I/O handle 285.

Logical time handler 284 is used to time out periods of delay in subprogram execution so that other subprograms may be executed during what would otherwise be nonproductive idle periods. This minimizes the accumulative inactive period of all tasks which must be performed in real-time. This also ensures that certain critical tasks pertaining to turbine-generator operation are executed with some minimum frequency. The logical I/O handler 285 provides real-time asynchronous input/output between peripheral devices and subprograms running under the real-time multitasking supervisor 272 of FIG. 11. For both input and output requests, the status of the designated input or output device is tested. If busy, the requesting subprogram is suspended temporarily from execution until a signal is received which establishes that access to the I/O device is available. On gaining access, other subprograms are blocked from access to the I/O device until the data transfer is complete. For data transfers, the logical I/O handler 285 tests the transfer status and if the transfer status indicates lack of "readiness," the requesting subprogram is suspended until a signal is received that indicates "readiness" for transfer.

Figure 13:
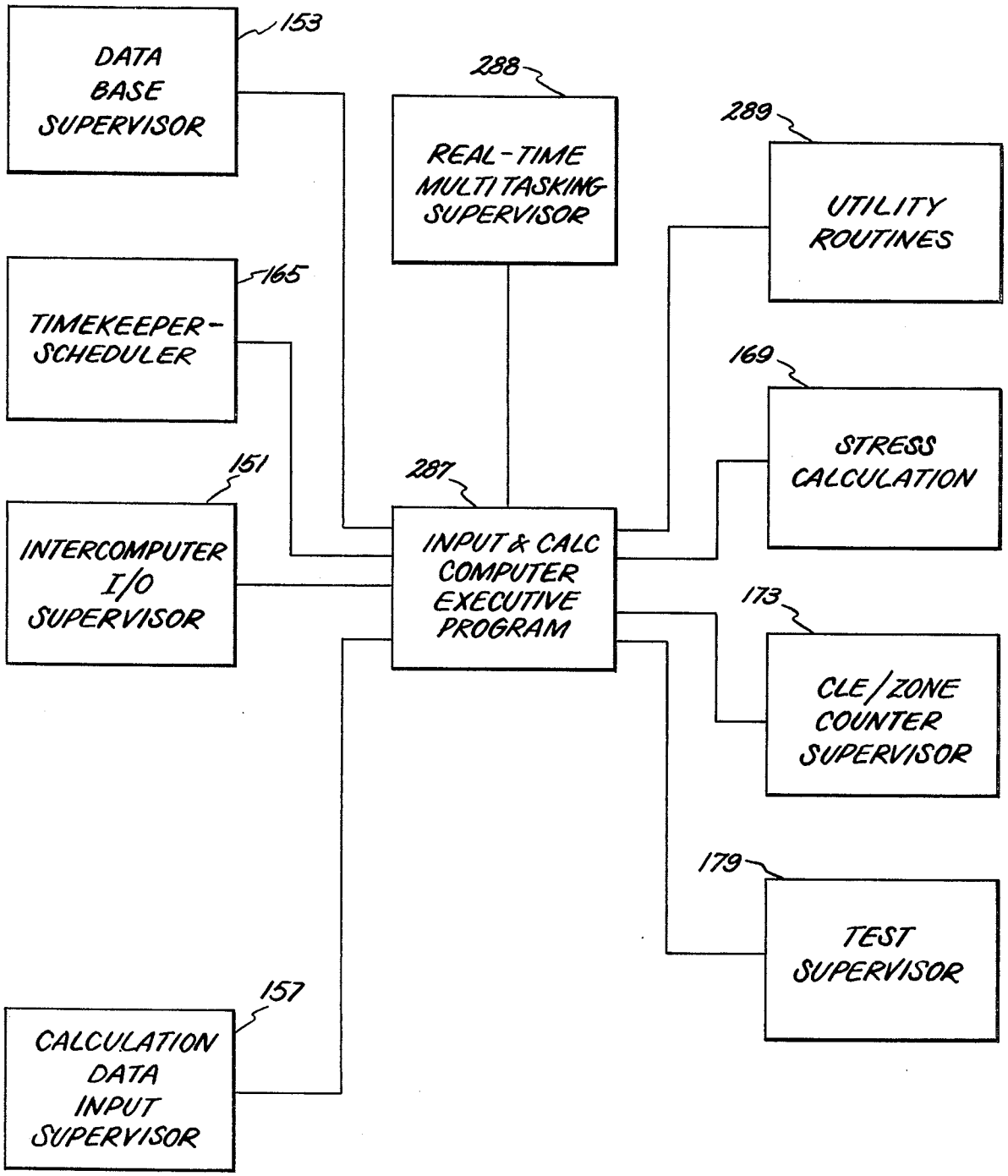
FIG. 13 is a block diagram illustrating the interrelationship between subprograms and an executive program for the input and calculations computer of FIGS. 1 and 3.

FIG. 13 illustrates the interfacing of tasks or subprograms to an executive program 287 for the input and calculations computer. Real-time multitasking supervisor 288 is a supervisory program central to the operation of the executive program 287 and is responsible for performing or controlling bookkeeping and scheduling type functions, including (1) boot-strapping, (2) task scheduling according to priority, (3) interrupt handling, (4) error handling, and (5) I/O control. Executive program 287, in conjunction with real-time and multitasking supervisor 288, interfaces with and supervises execution of all of the subprograms illustrated in the program structure and message flow diagram of FIG. 8. Identical reference numerals designate the same task in both figures. FIG. 13, however, further illustrates the interfacing of the executive program 287 to a group of utility subroutines 289. The utility routines 289 supplies routines for performing calculations, data manipulations, and other operations necessary for the proper functioning of the other subprograms of FIG. 13. Included in the Table 1 of subroutines are those available through utility routines 289.

Figure 14:
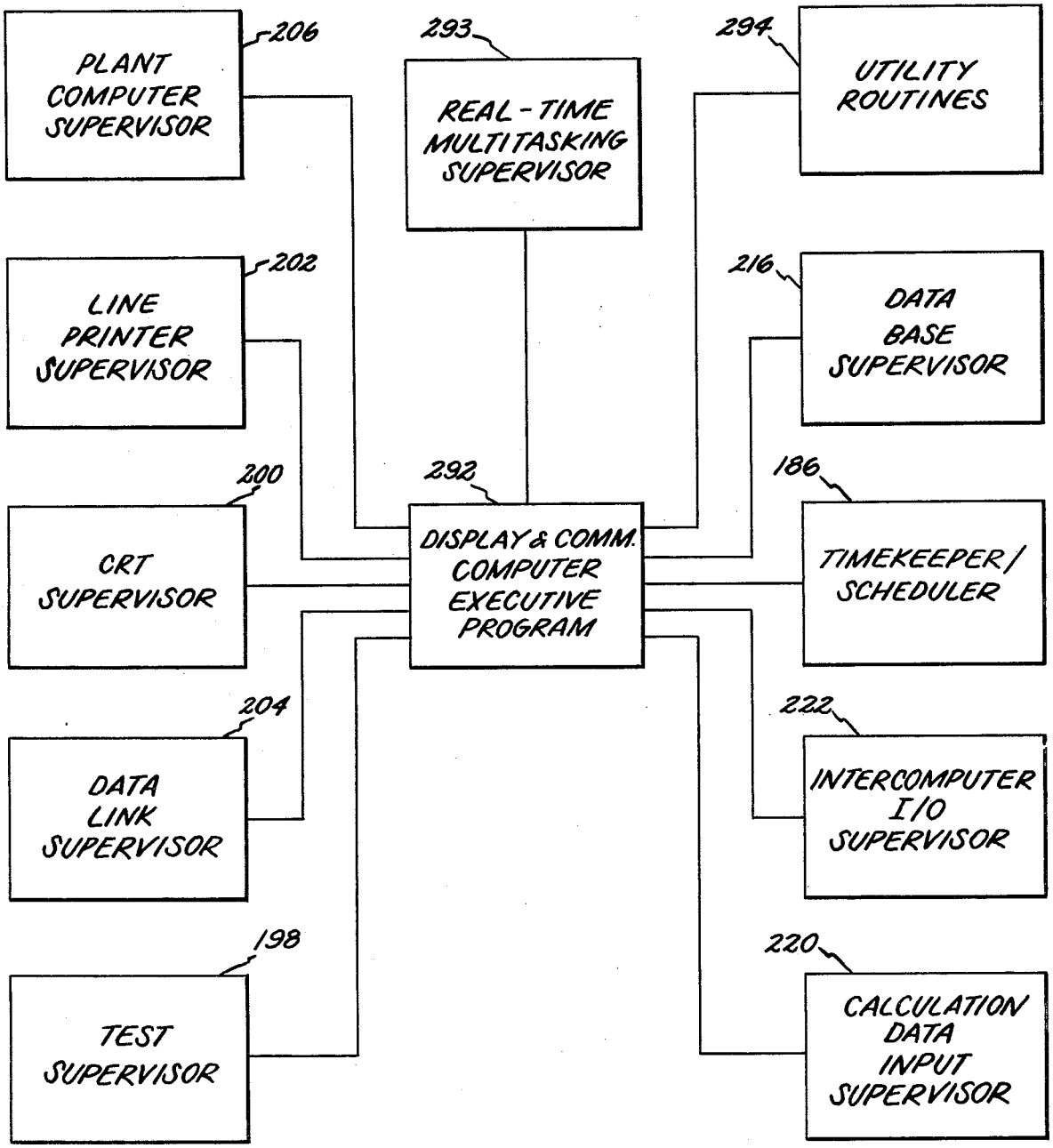
FIG. 14 is a block diagram illustrating the interrelationship between subprograms and an executive program for the display and communications computer of FIGS. 1 and 5.

FIG. 14 shows the interfacing of an executive program 292 to subprograms or tasks for the display and communications computer, and may be taken in conjunction with FIG. 9 to further illustrate the software coordination and structure for the display and communications computer. Reference numerals in common denote subprograms or tasks identical in both figures. Real-time multitasking supervisor 293 of FIG. 14 is the general purpose program which schedules the execution of other tasks according to priority, provides bookkeeping for orderly program execution, and performs or controls other functions listed above for the corresponding multitasking supervisor programs of other computers. The group of utility routines 294, drawn from Table 1 makes a number of frequently used routines available to all of the other tasks which are under the jurisdiction of executive program 292.

Programming the supervisory controller 25 to start, load, and unload a turbine-generator in the most efficient, economical, and least stressful manner is carried out according to automation flow charts of the type made available by turbine manufacturers. These automation flow charts have, in the past, been commonly supplied to facilitate the programming of large main frame type computers to achieve computer supervisory control of the turbine-generator. Automation flow charts provide a step-by-step progression of operations, conditions, and decisions which must be made or satisfied in controlling a turbine through its many operating phases. It will, or course, be apparent to those of ordinary skill in the art that such automation flow charts may be used to program the dedicated hierarchical microcomputer complex of the present invention.

Figure 15:
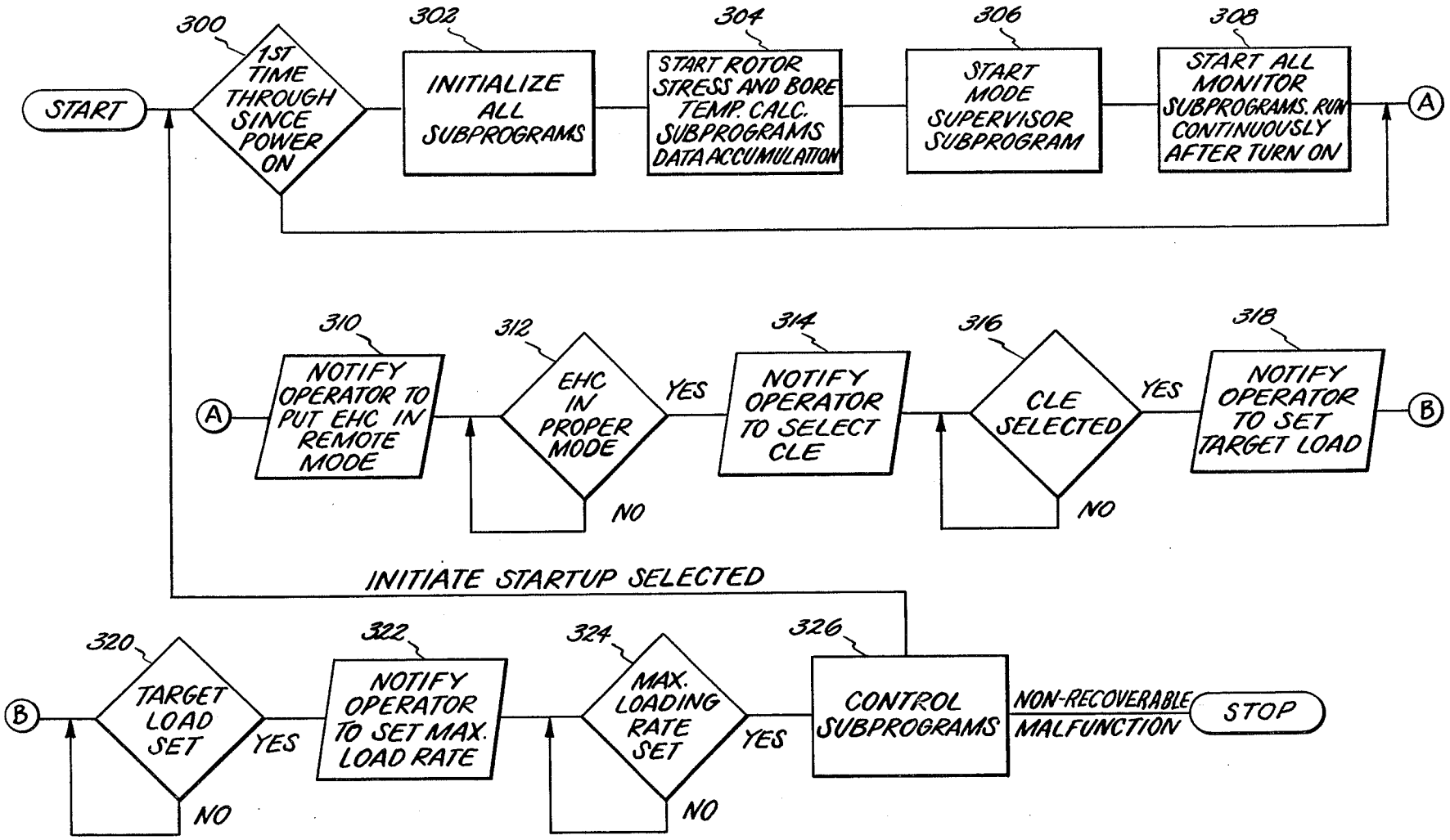
FIG. 15 is a simplified flow chart illustrating program steps performed to bring the microcomputer control system of FIG. 1 to an operational state.

An automation flow chart, somewhat simplified from that ordinarily available from turbine manufacturers, but indicative of the process by which the supervisory controller 25 is brought into an operational state and into condition for entry into subprograms for starting and loading a turbine-generator is shown in FIG. 15. The illustrated sequence of events is entered whenever the supervisory controller is turned on. First, a determination is made in decisional step 300 as to whether there has been a previous progression through the loop. If not, there follows a step 302 for initializing all subprograms; a step 304 in which the subprogram for determining rotor stress and bore temperatures is initialized to accumulate data pertaining to rotor warmup; a step 306 in which checks are made to ensure that the proper operating mode of the supervisory controller is in effect; and a step 308 to start all subprograms for monitoring turbine-generator operating parameters including, for example, steam temperature and input signal validity. Steps 302–308 are then omitted on turbine-generator startups subsequent to initial power-up. Remaining steps include steps 310 and 312 to ensure that the EHC system is properly set; steps 314 and 316 to ensure proper selection of cyclic life expenditure for a startup; steps 318 and 320 to ensure that a target load is set; and steps 322 and 324 to obtain an operator selected maximum loading rate. Finally, a step 326 is provided in which a control program such as turbine-generator startup supervisor 247, discussed briefly above in connection with FIG. 10, may be entered. If, at any time during or subsequent to the control subprogram 326, a nonrecoverable malfunction occurs within the supervisory control system 25 (for example, as may be detected by one of the watchdog timers) the control process is brought to an end and a safe operating mode is forced on all controllers as has been described above. However, there may be other events in which the control process may be interrupted (for example, by the operator) and in which case it may later be desired to be resumed. Such resumption is indicated by a return to "start," requiring, in some cases, that the startup be reinitiated by the operator.

Figure 16:
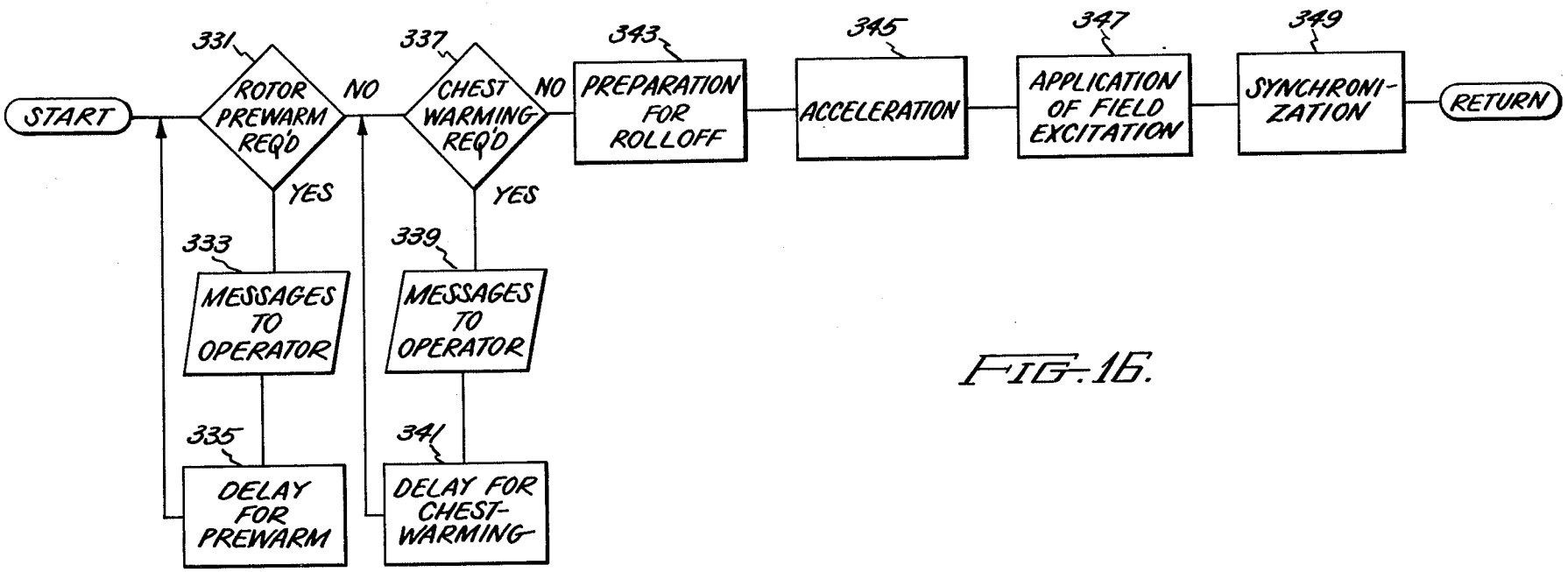
FIG. 16 is a simplified flow chart illustrating the program steps followed by the control computer of FIGS. 1 and 4 in performing the turbine-generator startup supervisor subprogram of FIG. 10.

Another simplified flow chart, the basis for providing the turbine-generator startup subprogram 249 of FIG. 10, is shown in FIG. 16. Upon entering the startup subprogram 247, a first determination step 331 is provided to determine whether rotor prewarming is required. If so, appropriate messages are given to the operator in step 333 followed by a delay for operator action and prewarming to take place in delay step 335. These steps 331 and 333 may be repeated until rotor prewarming is complete. The prewarming step is essentially a manual operation with the controller providing guidance. Its purpose is to assure that the rotor bore material has enough ductility for the centrifugal stresses which occur as the rotor accelerates. Minimum temperatures at three locations within the turbine must be reached and the rotor shell sufficiently warmed before the startup can proceed further.

Once the rotor is up to a safe operating temperature, a step is provided for determining whether the steam chest (not specifically shown in the Figures) of the control valves requires delay for warming and pressurization to take place. If such is the case, the operator is alerted by appropriate messages in step 339, followed by the necessary delay step 341. Chestwarming consists of two phases: (1) control valve chest pressurization, and (2) heat soaking. In the pressurization phase a determination is made, based on temperature differences between the steam and the valve chest outer wall, whether the valve chest can be quickly pressurized or must be pressurized slowly. In any case, pressurization proceeds at a rate which prevents excessive temperature differences. When the chest pressure reaches 85 percent of the main steam pressure the heat soaking phase of chestwarming begins. In this phase a gradual warming at pressure is allowed until the difference between main steam temperature and valve chest outer wall temperatures has decayed sufficiently to prevent excessive temperature differences during turbine acceleration. With these conditions satisfied the control valve chest is ready for turbine rolloff.

Preparation of the turbine for rolloff step 343 includes checks to assure that all control equipment is properly set for automatic startup, that the generator field is adequately warmed, that steam enthalpy is sufficient, and that there are no remaining excessive temperature mismatches within the turbine. Once these conditions are satisfied and the control system is free of alarms, the turbine is ready for acceleration step 345 which provides control of the speed and acceleration rate of the turbine-generator in accordance with the prewarming requirements and thermal stress level limitations. Acceleration rates are dictated by thermal stress levels at the surface of the high-pressure stage rotor. Interim speed holds are provided before reaching the target speed so that heat soaks can be used to reduce rotor thermal stress. Such speed holds are also dictated by steam to metal temperature mismatches to limit thermal stresses from anticipated changes in heat-transfer coefficients. Stresses and bore temperatures are calculated by subprograms executed by the input and calculations computer 28 of FIGS. 1, 3, and 8, and the results provided to the control computer 26 in performing the acceleration step 345 of FIG. 16.

Once the turbine has reached its target speed, the next operation in the startup subprogram is to apply generator field excitation. The application of field, step 347, initiates application of the field and verifies that the generator output voltages are matched to the line voltages of the power system to which the generator is tied. Field excitation may be controlled manually or by wired logic in an external excitation system (not specifically shown in the drawings). The excitation system will be notified when field excitation is required and the turbine speed is at least 98 percent of target speed. The excitation system returns a signal upon achieving a voltage match between the generator output and the power distribution system so that startup task can proceed to the synchronization step 349 which provides further checks of the turbine speed and makes determinations as to whether line speed matching apparatus (included in the EHC system 22 of FIG. 1) and equipment to provide automatic synchronization are in service. Messages are given to an operator in the event these items are not in service and the operator may override holds in the subprogram that occur in such cases. With the turbine-generator synchronized the control computer 26 of the hierarchy may direct its attention to a subprogram—such as loading rate supervisor 243 of FIG. 10 for loading the turbine to a target load.

Figure 17:
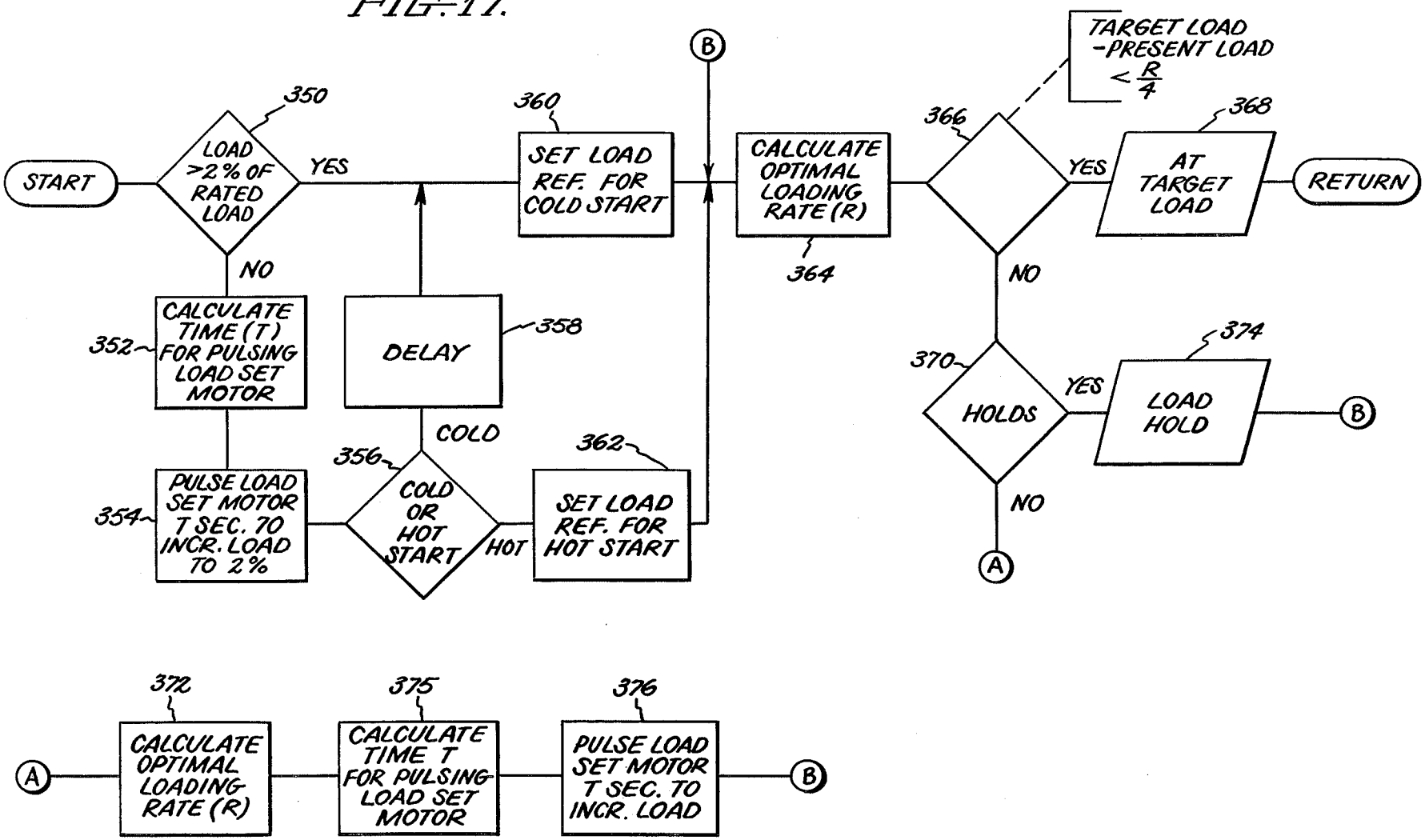
FIG. 17 is a simplified flow chart illustrating the program steps followed in performing the loading rate supervisor subprogram of FIG. 10.

The supervisory controller of the present invention is programmed to load a turbine-generator according to the simplified flow chart of FIG. 17 and as more fully disclosed in the aforementioned U.S. patent application Ser. No. (17TU-2828) for "Method And Apparatus For Thermal Stress Controlled Loading Of Steam Turbines" to Westphal et al assigned to the assignee of this application and which disclosure is herein incorporated by reference. With the operator having selected a target load, the first step 350 of the loading subprogram is to determine whether the turbine is minimally loaded above a minimum load, e.g., two percent of rated load. If not, steps 352 and 354 are included to bring the turbine load up to this minimum load by increasing the load setting in the electrohydraulic control system through a load set motor included in the EHC system. The time duration for which the load set motor is to run and therefore how much the load is to be increased is first calculated in step 352. The calculated time is a function of steam pressure, minimum load, and load set motor speed. Following the increase to a minimum load, there is a program step 356 for determining whether the turbine startup is under hot or cold conditions. This determination is based on whether the first-stage rotor surface stress is positive (cold) or negative (hot). If there is a cold start there is a delay period 358 prior to selecting a load reference value in the next program step 360. In the event the turbine is being started under hot conditions the load reference is set to a minimum load value (2 percent) in the separate step 362 for hot starts. The load reference in either case is used in calculations to determine the time duration for pulsing the above-mentioned load set motor.

Having set the load reference for either a hot or cold startup, there follows a step 364 to calculate the optimal loading rate for the turbine. This step 364 is actually a subprogram which provides a loading rate such that turbine rotor stresses are maintained within limits. The rate of change of stress and of steam temperature, as well as their instantaneous values are used in the calculation. This permits faster and more uniform loading of the turbine-generator. The subroutine of this step 364 also includes the calculation of an initial loading rate which is used only during the first part of a startup to avoid inappropriately high calculated rates due to initially low rotor stresses. The calculated loading rate is used in the following step 366 to determine whether the present load is acceptably close to the target load. The criterion is that the present load be within a small percentage of the target load. If the criterion is satisfied, the operator is notified by message 368 and the loading subprogram is complete. On the other hand, if the present load is not sufficiently close to the target load, the program checks for various holds in the next step 370 and either holds as desired or proceeds to calculate a new loading rate at step 372. Examples of holds which may occur include operator imposed holds, holds for generator warming, holds due to valve chest wall temperature differences, low rotor bore temperature, or excessive rotor expansion, and holds due to excessive main steam pressure. Appropriate load hold messages are provided to the operator at step 374.

With a newly calculated loading rate from step 372, there is next provided a step 375 to calculate a time period during which the load set motor (located in the EHC system and activated as discussed above in connection with FIG. 4) will be pulsed to a new load setting. The time period calculated and the speed of the motor are determinative of the new load setting. The calculation of running time is based on the calculated optimal loading rate from the previous step 372 of the subprogram and on the load reference as set in steps 360 or 362. As part of the operation to determine a motor run time period, the load reference is incremented by a fraction of the calculated loading rate and the new load reference is used in subsequent calculations. With the calculated time period set, the next operational step 376 is to pulse the load set motor for that time duration. The program then returns through the first loading rate calculation step 364 and through decisional step 366, being routed therefrom to repeat steps 370–376 until the target load is attained with sufficient exactness.

It will be appreciated that a dedicated microcomputer based control system has been described herein which significantly advances the art of turbine-generator control. Comprising a hierarchy of microcomputers, the control system of the present invention provides the advantages of digital computer control without the attendant expense and support required for a large main frame computer. These advantages materially improve the reliability, availability, and cycling time of turbine-generator, and also increase the effectiveness of power plant operating personnel. Overall, there is a significant contribution to a reduction in the cost of producing electrical power.

While the invention has been shown and described in detail with respect to a preferred embodiment, it is understood that various modifications and adaptations will be apparent to those skilled in the art. It is intended to claim all such modifications and adaptations which fall within the true spirit and scope of the present invention.

What is claimed is:

1. In combination with a turbine-generator set having a feedback control system operative in a manual mode and in a remote supervisory mode for operational control of said turbine-generator, a supervisory control system for providing direction to the feedback control system whereby the turbine-generator is controlled through all phases of operation to provide the quickest turbine-generator response without exceeding allowable levels of thermal or mechanical stress, said supervisory controller comprising:

an analog interface subsystem for receiving from said turbine-generator analog signals representing operating parameters thereof and for converting said analog signals to digital data signals;

a hierarchy of microcomputer subsystems wherein there is a distribution of function between such microcomputer subsystems, said hierarchy including an input and calculations microcomputer for receiving said digital data signals and for deriving therefrom other turbine generator operating parameters including thermal and mechanical stress values imposed on component parts of said turbine-generator, a display and communications microcomputer for inter-communication with peripheral equipment and operating personnel, and a control microcomputer for receiving information from other microcomputers of the hierarchy, for making decisions based on said information, and for providing said feedback control system with control directions; and a plurality of shared memory units, each unit of which is shared between at least two microcomputers of the hierarchy and through which information is exchanged and shared between microcomputers of the hierarchy.

2. The combination of claim 1 wherein said plurality of shared memory units comprises (a) a dual-port read/write memory unit shared between said input and calculations computer and said control computer, and (b) a dual-port read/write memory unit shared between said display and communications computer and said control computer.

3. The combination of claim 2 wherein said supervisory control system further includes means for manually selecting any one of a plurality of supervisory control system operating modes, said operating modes including a monitor mode wherein said supervisory control system monitors turbine operating parameters and annunciates information according to which operating personnel can direct said feedback control system, a control mode wherein said supervisory control system automatically directs said feedback control system with restricted interaction with operating personnel, a remote automatic mode wherein said supervisory control system is operatively coordinated with a central load control system for control of turbine-generator loading, and a plant computer control mode wherein said supervisory control system is operatively coordinated with a central computer.

4. The combination of claim 3 wherein said supervisory control system further includes a failure monitor means for continuously monitoring the performance of said supervisory control system; and mode select means for automatically switching said supervisory control system to said monitor mode upon performance failure as determined by said failure monitor means.

5. The combination of claim 4 wherein said supervisory control system includes a control panel providing for interaction with operating personnel, said control panel including means for manually switching said supervisory control system to operate in any one of said plurality of operating modes, a display unit for visual indication of data transferred between said supervisory control system and operating personnel, a program control keyboard for exercising manual control of program execution and for entering control data, means for indicating malfunctions within said supervisory control system, means for preselecting the turbine-generator target load and loading rate, means for initiating and controlling automatic startup of said turbine-generator, and means for preselecting an allowable expenditure of turbine rotor life during non-steady state operation of said turbine-generator.

6. The combination of claims 1, 2, 3, 4, or 5 wherein each microcomputer of said hierarchy includes:

a central processor unit (CPU) for executing instruction steps of a stored program, said program characterizing the operation of the microcomputer;

a read-only memory unit (ROM) for permanent storage of data and instructions comprising said stored program;

a random access memory unit (RAM) for interim storage of data produced by execution of said program;

a high-speed arithmetic processor network for performing mathematical operations in accord with execution of said stored program;

interfacing networks for compatible transfer of signals into and out of said hierarchy;

an internal communications and interrupt network for exchange of interrupt signals and coordination of operation with other computers of the hierarchy; and a bus system for interconnection of constituent parts comprising the microcomputer, said bus system including an address bus, a control bus, and a data bus.

7. The combination of claim 6 wherein said failure monitor means comprises for each microcomputer subsystem, a watchdog timer network updated periodically by the operation of the associated microcomputer, said watchdog timer providing a performance failure signal to said mode select means upon failure to be updated.

8. The combination of claim 7 wherein said input and calculations microcomputer provides a continuous comparison of said derived values of mechanical and thermal stress with reference values thereof to establish cyclic life expenditures of turbine component parts and occurrences of stress within preestablished zones of risk of permanent damage, said input and calculations microcomputer further including:

means for accumulating said cyclic life expenditures to determine a total life expenditure;

scoring means for totalizing occurrences of stress within said preestablished zones, there being one scoring means for each preestablished zone; and means for interfacing said accumulating means and said scoring means to said input and calculations microcomputer.

9. The combination of claim 8 wherein said analog interface subsystem includes a plurality of analog to digital converters for converting said analog input signals to digital signals compatible with microcomputer processing; and an isolation amplifier network for buffering said analog input signals for said analog to digital converters.

10. The combination of claim 9 wherein said supervisory control system further includes a cathode ray tube display unit for visual presentation of data and messages generated by said supervisory control system; and a display generator for interfacing said cathode ray tube display unit to said display and communications computer and converting coded digital data signals received therefrom to corresponding data and messages for display to operating personnel.

11. A control system for a turbine-generator, comprising:

means for sensing operating parameters of said turbine-generator to produce signals representative of said operating parameters;

an electrohydraulic control system for feedback control of said turbine-generator according to set point values of turbine-generator operating parameters, said electrohydraulic control system having a remote supervisory control mode of operation and a manual mode of operation; and a dedicated microcomputer based supervisory control system comprising a hierarchy of microcomputers providing distributed control functions between microcomputers of said heirarchy, said supervisory control system having a stored program of operation for determining thermal and mechanical stress on said turbine-generator from said operating parameter signals and from a stored data-base of other turbine-generator parameters to derive set point values for said electrohydraulic control system according to which said turbine-generator is controlled to produce the most rapid response during all phases of turbine-generator operation without exceeding predetermined levels of said thermal and mechanical stress, said supervisory control system being operatively connected to said electrohydraulic control system and operative in a control mode to automatically transfer said set point values to said electrohydraulic control system and operative in a monitor mode to present operating personnel with said set point values for manual transfer to said electrohydraulic control system.

12. The control system of claim 11 wherein said microcomputer based supervisory control system includes an analog input interface network for receiving said operating parameter signals and for converting analog values thereof to digital signals for processing by said microcomputer based control system.

13. The control system of claim 12 wherein said microcomputer hierarchy includes a display and communications computer for interactive control with operating personnel; an input and calculations computer for receiving said operating parameter signals and for deriving therefrom other turbine-generator parameters; and a control computer for decisional control of said electrohydraulic control system, said control computer being operatively, connected to said display and communications computer, to said input and calculations computer, and to said electrohydraulic control system.

14. The control system of claim 13 wherein said microcomputer hierarchy includes at least one random access multi-port memory unit shared among computers comprising said microcomputer hierarchy for providing exchange of information between said computers.

15. The control system of claim 13 wherein said microcomputer hierarchy includes:

a first random access dual-port memory unit shared between said control computer and said display and communications computer for exchanging information therebetween; and a second random access dual-port memory unit shared between said control computer and said input and calculations computer for exchanging information therebetween.

16. The control system of claim 15 further including means for manually selecting one of a plurality of operating modes for said supervisory control system, said plurality of operating modes including said control mode, said monitor mode, a remote automatic mode wherein said supervisory control system is operatively coordinated with a centralized load dispatching system for control of turbine-generator loading, and a plant computer control mode wherein said supervisory control system is operatively coordinated with a centralized computer.

17. The control system of claim 16 further including:

means to detect any one of a set of predetermined malfunctions within said supervisory control system; and means to automatically switch said supervisory control system into said monitor mode and said EHC system into said manual mode in response to a malfunction as detected by said failure detect means.

18. The control system of claim 17 wherein each computer of said microcomputer hierarchy includes:

a central processor unit (CPU) for executing instruction steps of a stored program, said program characterizing the operation of the computer;

a read-only memory unit (ROM) for permanant storage of data and instructions comprising said stored program;

a random access memory unit (RAM) for interim storage of data produced by execution of said stored program;

a high-speed arithmetic processor network for performing mathematical operations in accord with execution of said stored program;

interfacing networks for compatible transfer of signals into and out of said hierarchy;

an internal communications and interrupt network for exchange of interrupt signals and coordination of operation with other computers of the hierarchy; and a bus system for interconnection of constituent parts comprising the computer, said bus system including an address bus, a control bus, and a data bus.

19. The control system of claim 18 wherein said means to detect any one of a set of predetermined malfunctions within said supervisory control system comprises for each computer of said microcomputer hierarchy:

a watchdog timer providing a malfunction indication upon failure to be periodically updated by satisfactory results from preprogrammed testing of the computer.

20. The control system of claim 19 wherein said supervisory control system further includes an operator panel for interactive control, said operator panel including:

means for manually switching said supervisory control system to operate in any one of said plurality of operating modes, a display unit for visual indication of data transferred between said supervisory control system and operating personnel, a program control keyboard for exercising manual control of program execution and for entering control data, means for indicating malfunctions within said supervisory control system, means for preselecting the turbine-generator target load and loading rate, means for initiating and controlling automatic startup of said turbine-generator, and means for preselecting an allowable expenditure of turbine rotor life during non-steady state operation of said turbine-generator.

21. The control system of claims 17, 18, 19, or 20 wherein said supervisory control system continuously compares thermal and mechanical stress as determined by said supervisory control system with predetermined reference values to establish cyclic life expenditures of turbine-generator component parts and to establish occurrences of stress within predetermined zones of risk of permanent damage, said supervisory control system further including:

means for accumulating said cyclic life expenditures to determine a total life expenditure:

scoring means for totalizing occurrences of stress within said predetermined zones, there being one scoring means for each such predetermined zone.

22. The control system of claim 15 wherein said means to detect any one of a set of predetermined malfunctions within said supervisory control system includes a power integrity monitor network for detecting an impending failure of operating power for said supervisory control system.

* * * * *